US008312910B2

(12) United States Patent
Zimmer

(10) Patent No.: US 8,312,910 B2
(45) Date of Patent: Nov. 20, 2012

(54) EASY ACCESS HANGING STRUCTURE FOR WINDOW ORIGAMI PANELS

(76) Inventor: Robyn A. Zimmer, Snyder, NY (US)

( * ) Notice: Subject to any disclaimer, the term of this patent is extended or adjusted under 35 U.S.C. 154(b) by 350 days.

(21) Appl. No.: 12/455,677

(22) Filed: Jun. 4, 2009

(65) Prior Publication Data

US 2009/0294077 A1 Dec. 3, 2009

Related U.S. Application Data

(63) Continuation-in-part of application No. 12/150,761, filed on Apr. 30, 2008, which is a continuation-in-part of application No. 11/406,036, filed on Apr. 18, 2006, now Pat. No. 7,487,818.

(60) Provisional application No. 61/130,898, filed on Jun. 4, 2008, provisional application No. 60/672,333, filed on Apr. 18, 2005.

(51) Int. Cl.
*E06B 9/08* (2006.01)

(52) U.S. Cl. ..... 160/121.1; 160/110

(58) Field of Classification Search ..... 160/121.1, 160/265, 84.03, 348, 124, 349.1, 349.2, 127, 160/108, 109, 110, 111, 112, 405, 330, 327, 160/354, 368.1, 123, 126, 84.01, 38
See application file for complete search history.

(56) References Cited

U.S. PATENT DOCUMENTS 534,828 A 2/1895 Hensel
1,442,255 A * 1/1923 Doner ..... 296/97.8
1,516,935 A 11/1924 Wachtel
1,525,478 A * 2/1925 Vroble ..... 160/110

(Continued)

FOREIGN PATENT DOCUMENTS

JP 2006-042964 A 2/2006

(Continued)

OTHER PUBLICATIONS

J. Bolsover et al, Windowstyling, 2000, pp. 64-66 and 1 page titled "Hooked Panel Blind", Conrad Octopus Limited, London.

(Continued)

*Primary Examiner* — David Purol
(74) *Attorney, Agent, or Firm* — James C. Simmons

(57) ABSTRACT

A curtain or other panel comprising a sheet of material having a plurality of fastener elements spaced along and adjacent the sheet perimeter to be attached to mating fastener elements respectively on a structural member for hanging one edge portion of the sheet from the structural member. The plurality of sheet fastener elements are positioned along and adjacent the sheet perimeter in a quantity and spacing over the entirety of the sheet perimeter to be attached to respective ones of the structural member fastener elements for hanging other edge portions of the sheet from the structural member so that the panel can be hung from the structural member in a variety of alternative origami-like patterns.

A structure and method for adding or changing or removing the panels. The mating fastener elements are attached to the lower edge of a pull-down shade or other pull-down member. The shade is pulled down so that the lower edge is at a lower position to allow easy access for adding or changing or removing panels to form the desired Window Origami pattern. Then the shade is raised so that the lower edge is at a desired upper position with the mating fastener elements concealed behind a valence leaving just the Window Origami pattern visible to be enjoyed. Codes and/or other instructions may be provided on the shade for forming one or more Window Origami patterns.

12 Claims, 17 Drawing Sheets

U.S. PATENT DOCUMENTS

| | | | | | |
|---|---|---|---|---|---|
| 1,764,396 | A | * | 6/1930 | Dreyfuss | 160/330 |
| 2,500,074 | A | * | 3/1950 | Hill | 160/123 |
| 2,520,653 | A | * | 8/1950 | Rand | 112/406 |
| 2,534,785 | A | * | 12/1950 | Mayer | 160/110 |
| 2,627,918 | A | | 2/1953 | Gordon | |
| 2,671,508 | A | | 3/1954 | Gordon | |
| 2,779,405 | A | | 1/1957 | Hess | |
| 3,186,474 | A | * | 6/1965 | Levitas | 160/238 |
| 3,265,116 | A | * | 8/1966 | Guffan | 160/121.1 |
| 3,433,281 | A | * | 3/1969 | Lukashok | 160/330 |
| 3,480,069 | A | | 11/1969 | Handwerker | |
| 3,545,085 | A | | 12/1970 | Stewart | |
| 3,759,398 | A | * | 9/1973 | Romney | 211/46 |
| 3,896,931 | A | * | 7/1975 | Franklin | 206/326 |
| 4,391,865 | A | | 7/1983 | Constance | |
| 4,644,991 | A | * | 2/1987 | Boyd | 160/38 |
| 4,739,815 | A | | 4/1988 | Altman | |
| 4,747,442 | A | | 5/1988 | Bade | |
| 4,907,636 | A | * | 3/1990 | Simon | 160/238 |
| 5,010,944 | A | | 4/1991 | Bussert | |
| 5,109,908 | A | | 5/1992 | Chen | |
| 5,127,460 | A | | 7/1992 | Abadi et al. | |
| 5,146,972 | A | | 9/1992 | Tacchella | |
| 5,191,922 | A | | 3/1993 | Wade | |
| 5,203,395 | A | * | 4/1993 | Koller et al. | 160/263 |
| 5,480,040 | A | | 1/1996 | Ryan | |
| 5,682,939 | A | * | 11/1997 | Vargo | 160/237 |
| 5,738,159 | A | | 4/1998 | O'Brien | |
| 5,755,545 | A | | 5/1998 | Banks | |
| 5,803,144 | A | | 9/1998 | Ives | |
| 5,894,876 | A | | 4/1999 | O'Brien | |
| 6,059,009 | A | | 5/2000 | Haiber | |
| 6,142,210 | A | | 11/2000 | Isoda | |
| 6,162,692 | A | | 12/2000 | Gardner et al. | |
| 6,192,962 | B1 | | 2/2001 | Glover | |
| 6,298,526 | B1 | | 10/2001 | Baumdicker et al. | |
| 6,477,751 | B2 | | 11/2002 | Baumdicker et al. | |
| 6,484,788 | B1 | | 11/2002 | Jerrell | |
| 6,662,845 | B1 | | 12/2003 | Palmer | |
| 6,832,642 | B2 | | 12/2004 | Titus et al. | |
| 6,923,236 | B2 | | 8/2005 | Lin | |
| 7,487,818 | B2 | | 2/2009 | Zimmer | |
| 2002/0007920 | A1 | * | 1/2002 | Lower | 160/38 |
| 2002/0029442 | A1 | | 3/2002 | Baumdicker et al. | |
| 2003/0116287 | A1 | | 6/2003 | Titus et al. | |
| 2003/0178161 | A1 | | 9/2003 | Kuchinsky | |
| 2004/0144505 | A1 | | 7/2004 | Johnson et al. | |
| 2004/0221973 | A1 | | 11/2004 | Hesse | |
| 2005/0011618 | A1 | | 1/2005 | Kee | |
| 2006/0289130 | A1 | | 12/2006 | Zimmer | |
| 2008/0011434 | A1 | | 1/2008 | Tascoe | |
| 2008/0283205 | A1 | | 11/2008 | Zimmer | |
| 2010/0032536 | A1 | | 2/2010 | Eagan | |

FOREIGN PATENT DOCUMENTS

| | | | |
|---|---|---|---|
| KR | 20-1997-0010154 | U | 3/1997 |
| KR | 20-1999-0022580 | U | 7/1999 |

OTHER PUBLICATIONS

R. Nilsson et al, Rum Att Leva I, 1991, 1 page, Utbildningsforlaget Brevskolan, Stockholm.

C. Clifton-Mogg, Curtains, 1997, 2 pages one titled "Details" and the other titled "Shades, Blinds, and Sheers," Ryland Peters & Small, London.

Porchsails.com, "Home" and "Create Your Own" worldwide web pages at prochsails.com, 2005, 2008.

Spring Window Fashions, LLC, "Dauphine Curtain Rod Installation Instructions," English portion, 2003.

Impex Systems Group, Inc., "389-202," package card for hooks, 2005.

* cited by examiner

FIG. 1
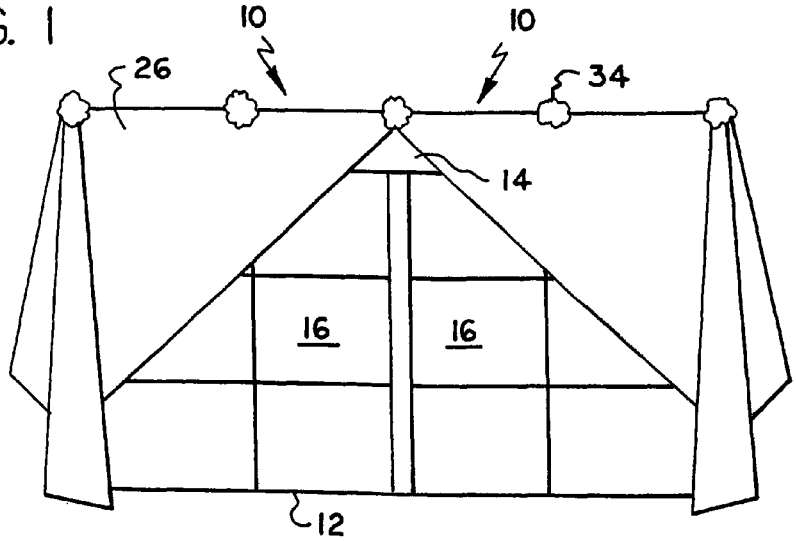
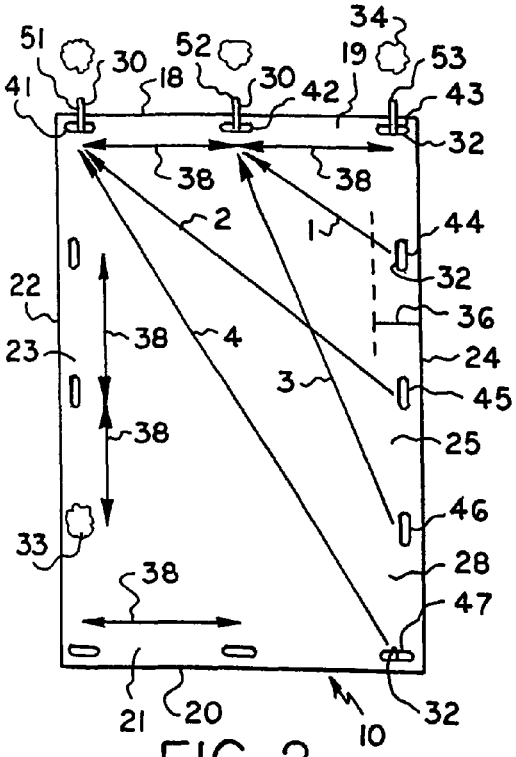
FIG. 2
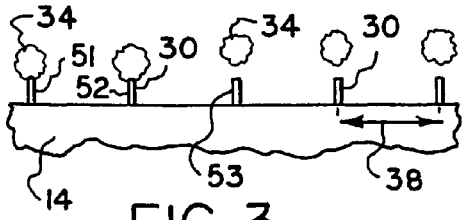
FIG. 3
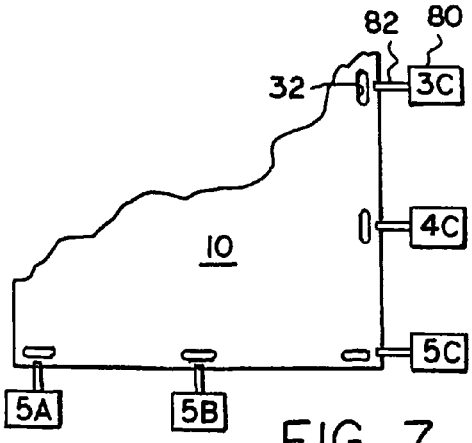
FIG. 7

FIG. 37
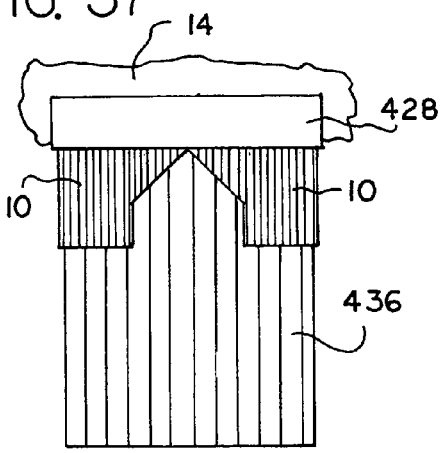
FIG. 38
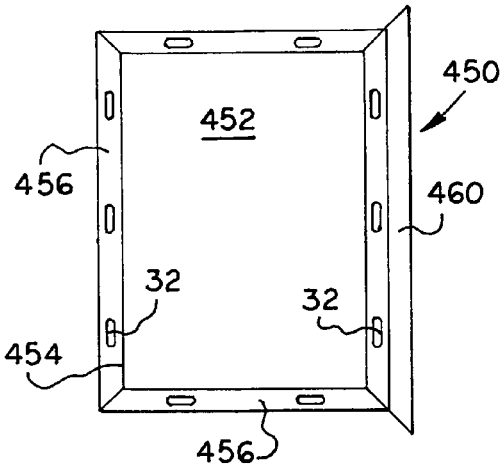
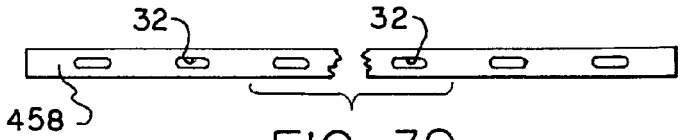
FIG. 39
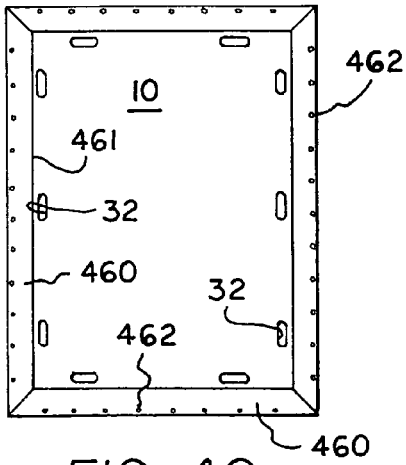
FIG. 40
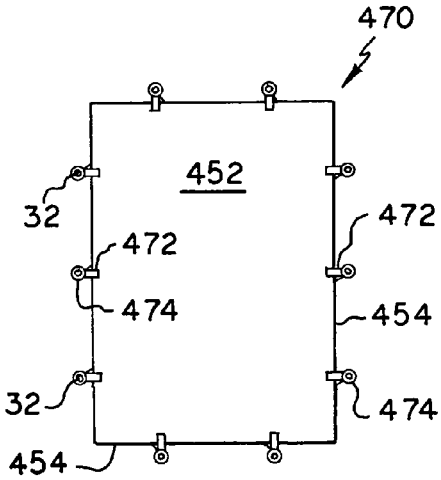
FIG. 41

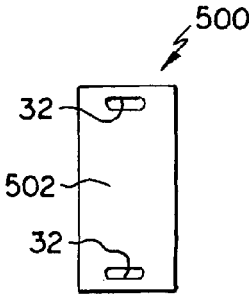
FIG. 42
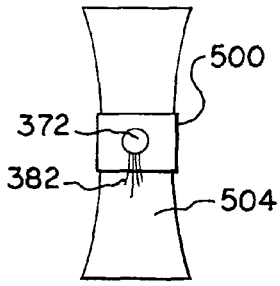
FIG. 43
FIG. 44
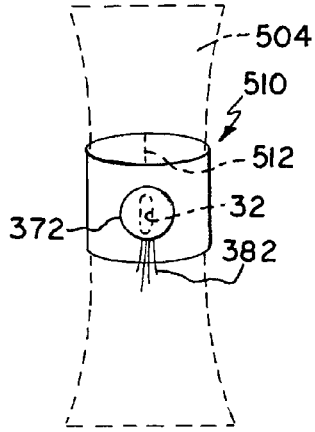
FIG. 45
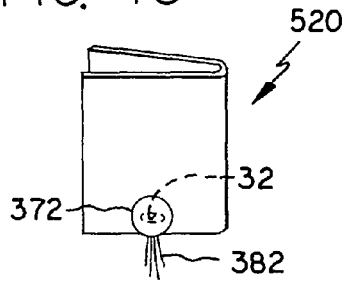
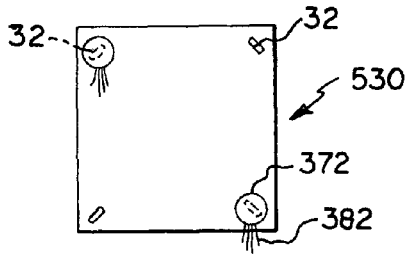
FIG. 46
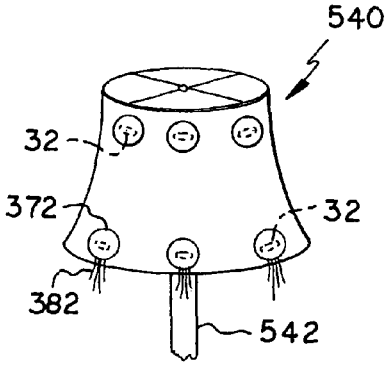
FIG. 47
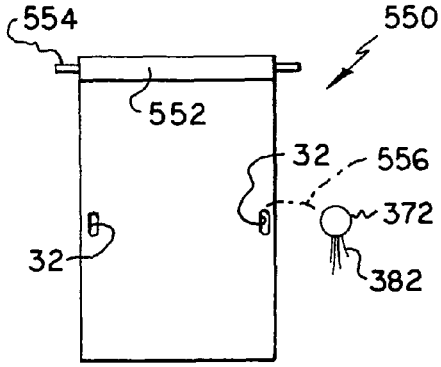
FIG. 48

EASY ACCESS HANGING STRUCTURE FOR WINDOW ORIGAMI PANELS

This application claims priority of U.S. provisional patent application Ser. No. 61/130,898, filed Jun. 4, 2008, and is a continuation-in-part of co-pending application Ser. No. 12/150,761, filed Apr. 30, 2008 (published Nov. 20, 2008, under publication no. 2008/0283205), which is a continuation-in-part of application Ser. No. 11/406,036, filed Apr. 18, 2006 (published Dec. 28, 2006, under publication no. 2006/0289130, and now U.S. Pat. No. 7,487,818, issued Feb. 10, 2009), which claims priority of U.S. provisional patent application No. 60/672,333, filed Apr. 18, 2005, and the disclosures of the above patent publications and applications are hereby incorporated herein by reference.

The present invention relates generally to window treatments, valances, draperies, hangings from walls as well as windows, or other curtains which are made of fabric or other suitable material and hang from upper window frames, ceilings, or other suitable structural supports as well as to decorative accessories for various objects as well as curtain panels.

U.S. Pat. No. 6,832,642 discloses a window treatment panel which comprises a row of equally spaced buttons positioned along an upper portion thereof (adjacent a suspending sleeve or tab tops for receiving a rod) and one or more vertically spaced rows of loops, similarly equally spaced as the row of buttons, extending horizontally along the surface of thereof, resulting in loops spaced along and adjacent each of the other three side edges of the panel. Any of the rows of loops is removably securable to the row of buttons respectively to enable at least a portion of the window treatment to be raised while it is positioned over the window opening, as seen in FIG. 2 thereof, i.e., to allow a lower portion of the window treatment to be raised vertically. The loop rows are spaced at gradually increasing intervals from the bottom of the fabric panel to the top thereof. It is stated in the patent that the rows of button means and loop means may be spaced as shown in FIG. 3 or in any type of spacing to achieve any desired effect. It is further stated that the rows of button means and loop means are shown in a horizontal arrangement but that they may be arranged in various angled and arced configurations to achieve a desired visual effect. In an alternative embodiment, the buttons and loops are interchanged. U.S. published patent application 2004/0144505 is related to the above patent and discloses another embodiment thereof wherein the buttons are replaced by ties.

U.S. Pat. No. 2,627,918 discloses drapery provided on both sides of an imaginary center line with two sets of generally equally spaced eyelets in the form of rings in a pattern of curved lines symmetrically arranged on opposite sides of the center line, and the end rings are provided with lace or ribbon strings tied thereto. In order to produce pleats or folds in the drapery and the appearance shown in FIG. 2 thereof, the ribbons are inserted through all the rings of the curved lines of rings respectively and tied together. See also U.S. Pat. No. 2,671,508.

U.S. patent application publication 2008/0011434 discloses a decorative curtain clip adapted to hold gathered curtains in a pre-selected arrangement and discusses other decorative devices for embellishing and holding curtains in various prearranged positions.

Other patents/published applications which may be considered to be of interest to the present invention include U.S. Pat. Nos. 534,828; 1,516,935; 2,779,405; 3,480,069; 3,545,085; 3,759,398; 3,896,931; 4,391,865; 4,739,815; 4,747,442; 5,010,944; 5,109,908; 5,127,460; 5,146,972; 5,191,922; 5,480,040; 5,738,159; 5,755,545; 5,803,144; 5,894,876; 6,059,009; 6,142,210; 6,162,692; 6,192,962; 6,298,526; 6,477,751; 6,484,788; 6,662,845; and 6,923,236, U.S. published patent applications 2002/0029442; 2003/0116287; 2003/0178161; 2004/0221973 (see also the "Home" and "Create Your Own" web pages at www.porchsails.com, 2005, 2008); and 2005/0011618, Korean patent documents KR 20-1997-0010154 U (published 1997) and KR 20-1999-0022580 U (published 1999), and Japanese patent document JP 2006-042964 (published Feb. 16, 2006). Non-patent literature which may be of interest includes J. Bolsover et al, *Windowstyling,* 2000, pp 64-66 and 1 page titled "Hooked Panel Blind", Conrad Octopus Limited, London; R. Nilsson et al, *Rum Att Leva I,* 1991, 1 page, Utbildningsfortaget Brevskolan, Stockholm; C. Clifton-Mogg, *Curtains,* 1997, 2 pages one titled "Details" and the other titled "Shades, Blinds, and Sheers," Ryland Peters & Small, London; and Spring Window Fashions LLC "Dauphine Curtain Rod Installation Instructions", 2003.

The disclosures of the above patents and published applications are incorporated herein by reference.

It is considered desirable to provide curtains which may be arranged in a multitude of various origami-like decorative/functional patterns (Window Origami patterns). The above references do not provide curtains which are capable, or at best are of only limited capability, of being effectively and aesthetically arranged in a multitude of alternative decorative/functional patterns and wherein the patterns can be changed easily and quickly.

Impex Systems Group, Inc. of Miami, Fla. markets one-step hooks which it calls OOK picture hanging hardware and which comprises a nail with an integrally attached washer intermediate its ends and angled to the axis of the nail. The nail is hammered into a wall until the washer is flush with the wall surface so that the protruding portion of the nail is securely inclined upwardly at a small angle suitable for hanging a picture. Double-sided screws have also been provided. The OOK nail does not provide for the use of decorative knobs. On the other hand, the screw threads of the double-sided screws may tend to cause the fabric to fray or be ripped as it is repeatedly hung in different patterns, and it may be desired by customers as well as more convenient to nail hooks into the wall rather than screw them in.

In a typical window installation, the user may have to climb on a ladder or the like to reach an installation strip with hooks for hanging the panels. This may be difficult for some people and may accordingly discourage them from changing the patterns as often as they may otherwise desire.

It is accordingly an object of the present invention to provide curtain panels which can effectively and aesthetically be arranged in a multitude of alternative decorative/functional patterns.

It is another object of the present invention to provide the capability of easily and quickly re-arranging the same curtain panel from one decorative pattern to another, using provided codes or the user creating his or her own design.

It is a further object of the present invention to provide easily installable hooks usable alone or with decorative knobs or the like and which protectively reduce the amount of fraying of fabric as the curtain panels are repeatedly re-arranged in different patterns.

It is yet another object of the present invention to provide easy accessibility to the installation strip and hooks wherein they can be lowered to a comfortable desired height for hanging the panels in various Window Origami patterns.

In order to provide curtains which can effectively and aesthetically, as well as easily and quickly, be arranged in a variety of alternative decorative patterns, in accordance with the present invention, a plurality of holes or other suitable fastener elements are spaced generally along all of the edge portions of a curtain sheet to connect to hooks or buttons or other suitable mating fastener elements on a curtain rod sleeve or other structural member. In accordance with another aspect of the present invention, a plurality of holes or other suitable fastener elements are substantially equally spaced along at least two adjoining edge portions of a curtain to connect to hooks or buttons or other suitable mating fastener elements on a curtain rod sleeve or other structural member. In order to hang a curtain in a desired one of a multitude of alternative decorative patterns, in accordance with the present invention, at least one first fastener element on a perimetric edge portion of the curtain is connected to a mating second fastener element on a curtain rod sleeve or other structural member and at least one first fastener element on an adjoining perimetric edge portion of the curtain is connected to a mating second fastener element.

In order to provide easy accessibility to the hooks wherein they can be lowered to a comfortable desired height for hanging the panels in various Window Origami patterns, in accordance with the present invention, the hooks (or other fastener elements) are suitably mounted on the lower edge of a pull-down window shade (or other pull-down sheet or structure). The shade is pulled down to allow easy access to its lower edge for adding or changing or removing curtain or other panels to form the desired Window Origami pattern. Then the shade is raised to the desired position for viewing of the curtains. The shade may be raised so that the hooks are concealed behind a valence leaving just the Window Origami pattern visible to be enjoyed. Codes and/or other instructions may be provided on the shade for forming one or more Windows Origami patterns.

The above and other objects, features, and advantages of the present invention will be apparent in the following detailed description of the preferred embodiment(s) thereof when read in conjunction with the accompanying drawings wherein the same reference numerals denote the same or similar parts throughout the several views.

BRIEF DESCRIPTION OF THE DRAWINGS

FIG. 1 is a front elevation view of a pair of curtain sheets or panels which embody the present invention and which are shown hung from a window frame in one of a multitude of alternative decorative/functional patterns.

FIG. 2 is a front view of one of the curtain sheets.

FIG. 3 is a partial detail view of the window frame.

FIG. 7 is a partial front view of the curtain panel of FIG. 2.

FIG. 37 is a front view of the cover member of either of FIG. 35 or 36, illustrating the hanging of curtains.

FIG. 38 is a front view of one of the curtain sheets having attached along the perimeter thereof individual strip(s) containing the curtain holes.

FIG. 39 is a front view of a strip of material from which the individual strips are cut.

FIG. 40 is a front view of one of the curtain sheets having attached along the perimeter thereof individual strip(s) for folding over and covering the holes.

FIG. 41 is a front view of one of the curtain sheets having attached along the perimeter thereof clips having rings which provide the holes.

FIG. 42 is a front view of a cuff, unfolded, for a napkin.

FIG. 43 is a front view of a napkin received in the cuff, folded.

FIG. 44 is a front view of a napkin, in phantom lines, received in an alternative embodiment of the cuff.

FIG. 45 is a front view of a napkin with a button hole to which is attached a decorative clip.

FIG. 46 is a front view of a napkin with button holes in two of which are received decorative clips.

FIG. 47 is a front view of a lamp shade which has button holes to which are attached decorative clips.

FIG. 48 is a front view of a curtain panel which has button holes and a decorative clip for connecting the button holes.

DETAILED DESCRIPTION OF THE PREFERRED EMBODIMENT(S)

Figure 4:
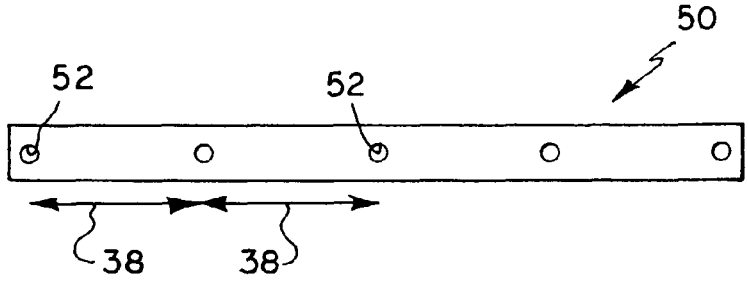
FIG. 4 is a plan view of a template for installing fastener elements for the curtains.

Referring to FIGS. 1 to 3, there is shown generally at 10 a pair of identical curtain sheets or panels serving as a window treatment for window 12. Window 12 is of conventional design, having an upper frame 14 from which the curtain sheets 10 are hung, as described hereinafter, and a plurality of suitably framed window panes 16. It should of course be understood that it is within the purview of the present invention that the window be covered by only one such curtain sheet 10 or that it be covered by more than 1 such sheet 10 (which may or may not be identical), and that the curtain sheet or sheets 10 may be used for other hangings in addition to window hangings, for example, to hang in front of a stage at a theater or to hang from the edge of a table top or to decorate a wall or other suitable surface such as a headboard.

FIG. 2 shows one of the curtain sheets 10 to be rectangular in plan view, with opposite end edges 18 and 20 which are shown to serve as the top and bottom respectively when hung, and opposite side edges 22 and 24 which are longer than the end edges. It should be understood that the curtain 10 may be hung so that any of the edges serves as the top edge. The curtain 10 may be otherwise suitably shaped (could also be other shapes), for example, square or round or triangular or oval or having a greater or lesser number of edges, and may be of any suitable size for its intended application.

The curtain is made of a suitable material, for example, a heavy fabric as is typical of curtains (although it is to be understood that a lighter fabric may be used). The fabric may be a themed fabric such as holiday or birthday-themed. The curtain may be made of a single material or a plurality of materials and may be made of one or more layers of material, i.e., layers 150 and 152 illustrated in FIG. 24. Since, as will be apparent in the discussion hereinafter, portions of both sides of the curtain will be visible at the same time for many (or most) of the multitude of alternative hanging patterns, it is important that both sides 26 and 28 of the curtain be finished, that is, completed and without a lining or the like showing so that each side has the same desired pleasing appearance. The curtain 10 is therefore reversible, i.e., hung so that either side 26 or 28 faces inwardly. The curtain material is desirably, but need not be, washable or otherwise easily cleanable. The curtain material may also be disposable for use, for example, in hospitals or nursing homes.

Figure 8:
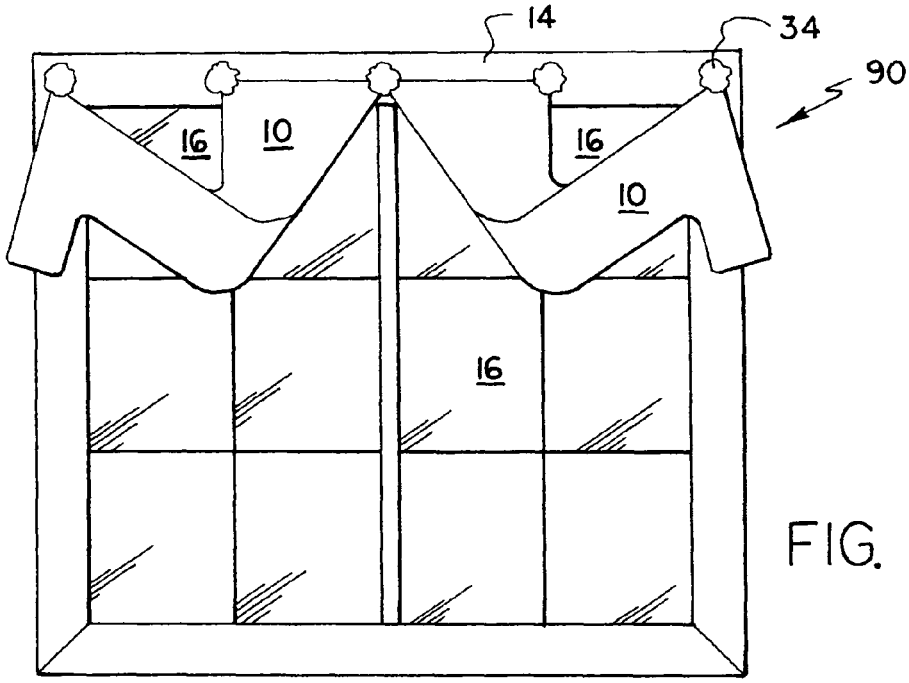
FIG. 8 is a view similar to that of FIG. 1 of the pair of curtain sheets arranged in an alternative pattern.

In accordance with the present invention, the two layers 150 and 152 (FIG. 24) allow the curtain 10 to have different colors or textures or appearances on its opposite sides, for a pleasing contrasting two-tone effect. Thus, FIG. 8 shows both sides of each curtain visible to a viewer at the same time, and these sides may have different colors or textures or appearances. In order to achieve this pleasing two-tone effect, it is also important that both sides be finished.

The upper window frame 14 is shown in FIG. 3 to have 5 fastener elements 30 equally spaced horizontally over the length thereof. These fastener elements 30 are illustrated as pins or rods or even nails but may be otherwise suitable for fastening as hereinafter described, for example, hooks, buttons, or Velcro material. Three of the fastener elements 30 including the middle one is shown to support one of the curtain sheets on one (right) window side and three of the fastener elements 30 also including the middle one is shown to support the other curtain sheet on the other (left) window side. The number of fastener elements 30 may of course vary, but at least one fastener elements 30 (for many applications two or more fastener elements 30) will be used to support a curtain sheet. Fastener elements 30 may alternatively or additionally be positioned on the wall (such as above the window frame) or ceiling to increase the variety of alternative patterns. If desired, fastener elements 30 may be located on a curtain rod or shaped header.

Each of the edges 18 and 20 defines an end perimetric edge portion 19 and 21 respectively, and each of the edges 22 and 24 of the curtain 10 defines a side perimetric edge-portion 23 and 25 respectively. It is seen that edge portion 19 adjoins at one end edge portion 23 and adjoins at the other end edge portion 25, and, similarly, each of the other edge portions adjoins an edge portion at each of its ends. For the purpose of this specification and the claims, a "edge portion" is defined as a portion extending along an edge of the curtain 10 and which has a width, illustrated at 36, of up to about 6 inches or otherwise of sufficient width to adequately accommodate the fasteners elements 32 in positions adjacent (within about 1½ inch of the respective edge) the curtain edges. For example, width 36 may be about 1 inch. It is to be understood that the present invention is intended to cover curtain panels that are irregularly shaped. If such an irregularly shaped panel cannot be defined to have a pair of side edge portions and a pair of end edge portions, then, for the purposes of this specification and the claims, if the fastener elements 32 are spaced entirely around the perimeter (within the 6-inch distance from the perimeter), then they are defined as being spaced along all of the edge portions, and if they are substantially equally spaced over a continuous distance of at least half of the perimeter of the panel, then they are defined as being substantially equally spaced along at least one of the side edge portions and at least one of the end edge portions.

Spaced along the edge portions 19, 21, 23, and 25 are a plurality of fastener elements 32 which mate with fastener elements 30 for connecting thereto for hanging the curtain 10 in the desired patterns. The fastener elements 32 are arranged sufficiently along the marginal edge portions 19, 21, 23, and 25 over a sufficient length and number to allow connecting of at least two of them along one of the edge portions to respective ones of the fastener elements 30 and to connect others of the fastener elements 32 along one or more other edge portions to the fastener elements 30 to form the decorative/functional hanging arrangements which will be discussed hereinafter.

Fastener elements 32 are shown as elongate holes or slits (like button holes) which extend through the thickness of the curtain for receiving the pins 30, as illustrated in FIG. 2, but may be otherwise as suitable for mating with fastener elements 30. As long as fastener elements 30 and 32 mate with each other for fastening, they may be any suitable fastener such as, for example and without limitation, hooks, grommets including speciality-shaped grommets, bows, tabs, rings, ribbons, Velcro material, magnets, beads, or loops of material having holes therein and extending from the curtain edges or from the window frame or otherwise. The fasteners 30 and 32 may have decorative shapes. Decorative covers, illustrated at 34, may be provided to screw onto or over or otherwise fasten to the fasteners. The fastener elements may also be reversed, for example, a hook attached to a panel to fasten to loop on a wall or other structure.

The fastener elements 32 are preferably button holes or otherwise unobtrusive (minimally noticeable) elements which do not unnecessarily detract from the pleasing appearance of the curtain, and fastener elements 30 are preferably pins or the like protrusions which mate with the button holes and whose outer ends can be covered with the decorative covers 34. Alternatively, the fastener elements 32 may be, for example, ties such as ribbons or strings or tabs. Decorative clips, tassels, or the like may be placed in/over the holes (or other fastener elements) 32, as illustrated by decorative clip 33 in/over one of the otherwise visible holes 32 in FIG. 2, to hide the holes from view. The use of the button holes 32 and pins 30 (as well as other fastener combinations which may be provided), desirably allow the traditional curtain rod to be eliminated, thus desirably allowing the curtain 30 to be easily and quickly put up and taken down (for cleaning, etc.) as well as re-arranged into any of a multitude of various alternative patterns as hereinafter described. Clip-on accessories can have other applications as well, for example, a clip on any surface such as on an edge of a lamp shade to accessorize or a clip in combination with a button hole. The present invention could be provided as a kit with clip-on rosette and fastening element to attach any decorative accessory of choice such as a tassel, beads, fringe, and the like. The kit may be provided to allow clips to be attached to decorative rosettes of choice; the kit could contain clip and adhesive to make clip-on accessories.

The perimetric edge portions 19, 21, 23, and 25 define the entire perimeter of the curtain sheet 10, as is evident from FIG. 2. In order to allow the curtains 10 to be re-arranged into a multitude of alternative decorative/functional patterns, as hereinafter discussed, the fastener elements 32 are preferably spaced along all of the edge portions 19, 21, 23, and 25, as shown in FIG. 2, to thereby cover the entire perimeter of the curtain.

For reasons that will hereinafter be discussed, in accordance with a preferred embodiment of the present invention, the fastener elements 32 are substantially equally spaced along at least one of the end edge portions 19 and 21 and at least one of the side edge portions 23 and 25, for example, along both edge portions 19 and 25. Preferably, the fastener elements 32 are substantially equally spaced along all of the edge portions, i.e., along the entire perimeter of the curtain sheet 10. Thus, the spacing, illustrated at 38 in FIG. 2, is generally equal, for example, about 13 inches, between pairs of fastener elements 32 as well as between window frame fastener elements 30, i.e., an occasional fastener element may be left out resulting in double the width 38 between a pair of fastener elements or there may be another hole between a pair of fastener elements having the spacing 38. The present invention also does not exclude holes or fastener elements in the central portion (inside of the edge portions) of the curtain 10 as well as additional holes or fastener elements in the edge portions. A panel need not have equally spaced elements on all edges, with just one or two on each of a pair of sides.

The window frame 14 is shown to have 5 equally spaced fastener elements 30 over its width, and the curtain sheet 10 is shown to have 3 equally spaced fastener elements 32 over its upper (as well as lower) edge portion 19 thus allowing two such sheets 10 to be hung side-by-side (with one fastener element 32 on each curtain sharing a common central fastener element 30 on the window frame 14), as illustrated in FIG. 1. The curtain sheet 10 is also shown to have 5 equally spaced fastener elements 32 along each of its side edge portions 23 and 25 whereby one of the side edge portions 23 and 25 may alternatively serve as the top of a single curtain extending across the entire width of the window.

Referring to FIG. 4, there is illustrated generally at 50 a template (an elongate sheet or cardboard or paper or other suitable material) or installation strip containing holes, illustrated at 52, having the spacing 38 for use by a customer in installing the fastener elements 30 so that they have the spacing corresponding to the spacing 38 of the fastener elements 32 in the curtains 10.

In accordance with the present invention, the equally spaced fastener elements 32 over the perimeter of the curtains 10 desirably allows the curtains 10 (or single curtain) to be hung in a multitude of alternative decorative/functional patterns of which the patterns shown in FIGS. 1 and 8 (described hereinafter) are but two examples. FIG. 2 illustrates how to achieve the left-hand side of the pattern of FIG. 1, the pattern for the right-hand side thereof being the mirror image thereof and therefore achieved similarly. The curtain is initially hung by inserting the three left-most window frame pins 51, 52, and 53 into the curtain upper edge portion holes 41, 42, and 43 respectively. Then pins 52 and 51 are inserted into side edge portion holes 44 and 45 respectively, as illustrated by arrows 1 and 2 respectively. As apparent in FIG. 2, this requires the previously discussed equal spacing 38 in order to effectively and aesthetically achieve the desired effect without excess material hanging around the window frame 14 in an unsightly manner. Finally, pins 52 and 51 are inserted into side edge portion holes 46 and 47 respectively, as illustrated by arrows 3 and 4 respectively. It is thus apparent that by connecting the fastener elements 30 and 32 in various other combinations, a multitude of alternative decorative/functional curtain patterns, in the nature of origami, may be desirably achieved. Similarly, another set of various alternative decorative curtain patterns may be achieved if one curtain 10 (or two side-by-side) is hung along one of its side edge portions 23 or 25 or if one panel is hung along an end edge and the other hung along a side edge. Two or more curtain sheets may be fully or partially stacked, i.e., hung from the same set of fastener elements 30 or sharing more than one fastener element 30 to achieve even more decorative/functional patterns.

Unequal spacing between fastener elements 32 as well as between fastener elements 30 may result in difficulty in connecting certain fastener elements 32 to certain fastener elements 30 and/or result in unsightly bunching of fabric when they are connected. Thus, the equal spacing between fastener elements 32 as well as between fastener elements 30, in accordance with the present invention as hereinbefore discussed, allows the desired connections to be easily made and allows the connections to be desirably "squared." However, it may sometimes be desirable to "skip" a hole or holes when hanging so as to achieve a draping or gathered effect. Thus, the equal spacing 38, while alleviating difficulty in connecting fastener elements so that connections may more easily be made and without unsightly "bunching," allows both a soft or gathered look and a "squared" look, as desired. More fastener elements can be added for this effect.

It may be difficult for a person hanging a curtain in one of the patterns to be able to readily identify a specific hole 32 needed for connection to a pin 30. In order to identify each hole, a tag system may be used such as illustrated in FIG. 7. As illustrated therein, a tag or flag 80 is clipped, by clip 82, to the position of each hole 32 so that it can be un-clipped therefrom when the desired pattern is formed. Each tag 80 is coded with a number, signifying the position vertically of the hole and a letter signifying the position horizontally of the hole, i.e., a first nomenclature of identifiers. Thus, for example, the tag marked with "5C" signifies the fifth hole from the top edge (in this case, the bottom hole) and the third hole from the left edge. The tags 80 may be otherwise suitably coded such as by color-coding. The coding may be permanently applied such as by being sewn into the fabric. It should of course be understood that other suitable coding (and other suitable means for applying it such as by an adhesive or by discardable or re-usable stickers) may be provided to allow a person to be able to readily identify a hole 32 when arranging a pattern. Thus, referring to a set of instructions providing a view of the curtain showing which hole each coded tag should identify, a person may clip the tags 80 onto a curtain panel 10 before arranging it in a desired pattern. He or she may then refer to the sequence of connections (also provided in the instructions or otherwise) for the desired pattern (for example, for the panel of FIG. 2 wherein the connector elements 30 and the upper panel connector elements 32 would both have the code 1, the sequence may be 2C to 1B, 3C to 1A, 4C to 1B, and 5C to 1A, wherein a second nomenclature of identifiers 1A, 1B, 1C in this instance contains the number 1 followed by left to right consecutive letters to identify respective horizontal positions of the connector elements 30 from which the curtain is hung), check the coded tags 80 to locate the corresponding holes for each sequential connection, and follow the sequence of instructions using the respective identifiers. When the pattern is completed, the coded tags 80 may be removed and saved until needed again for arranging another pattern. For another example, the panel connector elements 32 may be identified by numbers, and the connector elements 30 may be identified by letters. Decorative accessories may be used to further enhance the pattern. Thus, the user may flip through a booklet or set of cards of pictures of patterns along with the sequence of fastener connections for each pattern and choose a desired pattern to be arranged. Users may also create their own patterns and record their own codes, i.e., sequence of fastener connections.

The codes as well as the fastener elements 32 may, for example, be positioned between the edge portions of a pair of layers of fabric sewn together along a line at a short distance from the edges thereof. Thus, the codes may be permanently sewed or printed or otherwise placed on the inside of an edge portion where it will be generally hidden from view, and the holes may be eyelets of loops sewn to one of the layers so that they are generally hidden from view between the edge portions of the layers. This permanent sewing or printing or otherwise placement of the codes on the fabric as well as the tags or flags 80 or stickers thus constitute identifier structures and are thusly referred to as such in the claims.

The tags or codes 80, which may be physical elements pre-marked or blank for marking by the consumer and which may be stickers, reusable clamps or clips, or may be permanently attached to the holes/hooks, should not be construed as limited to physical attachments to the holes 32 and/or hooks 30, but may be other kinds of suitable codes identifying the holes/hooks, for example, a step-by-step diagram sold with the curtains 10 or even a web page containing such a diagram for use by the customer.

Figure 13:
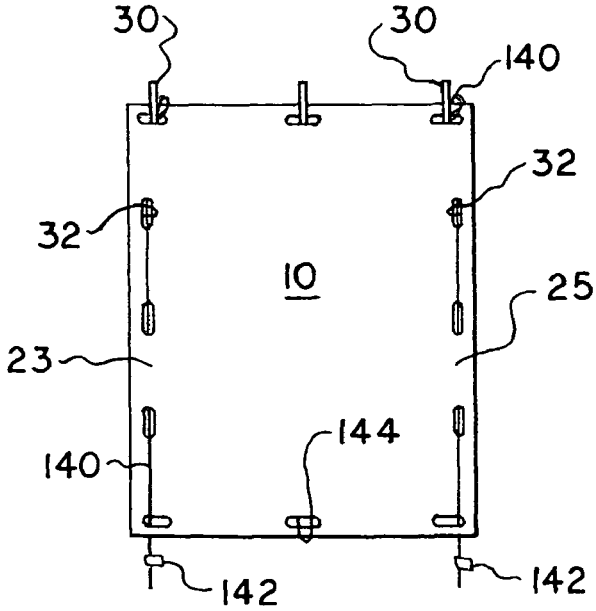
FIG. 13 is a front view of a curtain panel illustrating an additional use thereof.
Figure 14:
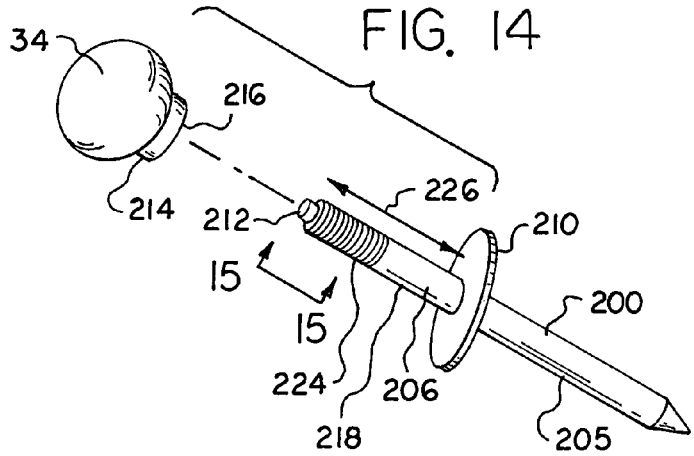
FIG. 14 is an exploded view of a hook and decorative knob assembly in accordance with the present invention for hanging the panels.

As illustrated in FIG. 13, for use similarly as a conventional Roman shade, a pair of strings or twine or ropes 140 may be threaded or laced through the holes 32 along each of the side portions 23 and 25 with their upper ends tied or otherwise suitably fastened to the respective hooks 30. The curtain panel 10 is bunched up toward the upper end thereby defining a Roman curtain like arrangement. The panel 10 may then be held in the Roman curtain like arrangement by applying clamps 142 or forming knots in the strings 140 or by threading through lower central hole 144 and tying the two strings 140 together or otherwise as suitable. Ribbon loops can be added to the loops on the perimeter of a panel and then arranged, hooking the ribbon to the wall fasteners for additional variety.

The curtains of the present invention may also be used as an educational toy for children. Thus, one or more panels may be fixed to a suitable surface such as, for example, a wall with one or a plurality of fixed clips marking the one or more fastener elements. This will allow a child to learn and practice skills such as colors, numbers, and visual concentration. The panels may be folded into animals or figures such as elephants or butterflies which may be more appealing to children. A web page may be provided to allow users to access additional codes to complete additional patterns. Accessories for the toy may include clip-on (or attached by another means such as Velcro material) eyes, nose, mouth, and other shapes to enhance the design for the toy.

Figure 5:
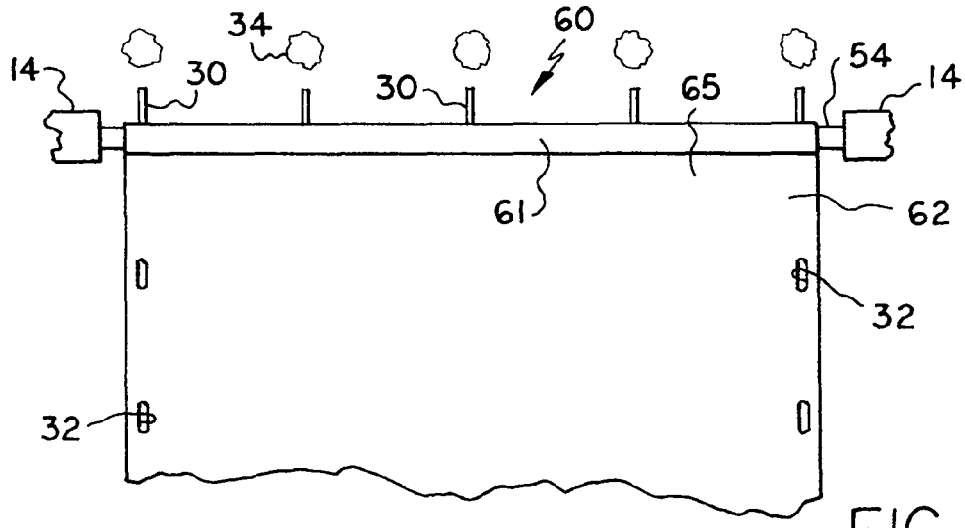
FIG. 5 is a partial front view of a curtain in accordance with another embodiment of the present invention.

Referring to FIG. 5, there is shown generally at 60 an alternative embodiment of the curtain wherein a curtain sheet or panel 62 is integrally sewn, or otherwise suitably attached, along its upper marginal portion 65 to a sleeve 61 (i.e., attached so that the sheet and sleeve are considered to be a single unit). As used in reference to the relation between the sheet 62 and sleeve 61 (as well as between the sheets 72 and sleeve 61 in FIG. 6) herein and in the claims, the term "attached" is meant to exclude the use of fastener elements 30 and 32 and is intended to refer to their being integral or sewn together or otherwise attached so that they are not separated during normal use. The sleeve 61 is received on curtain rod 54 which in turn is attached to the upper frame 14 and has the fastener elements 30 attached thereto. While shown as generally tubular in shape, it should be understood that the sleeve may be otherwise suitably embodied to receive rod 54, i.e., it may comprise a series of loops or tabs or ties (fabric strips that tie) or other eyelet formations for receiving the rod 54 and on which are received the fastener elements 30. Panel 62 is otherwise similar to panel 10 except that it of course need not have any fastener elements 32 along its upper marginal portion 65. The present invention does not require that the sleeve 61 be connected to the panel 62 as a single unit therewith in which event it would of course be necessary to have fastener elements 32 along the upper marginal portion 65. In order to arrange the curtain in a desired pattern, one or more of the fastener elements 32 as desired is raised and attached to one or more of the fastener elements 30 similarly as previously discussed with respect to FIGS. 1 to 3.

Figure 6:
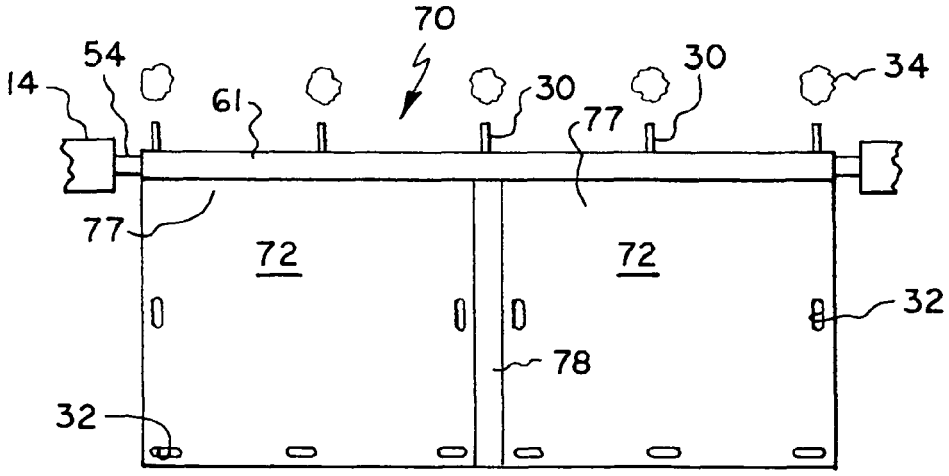
FIG. 6 is a front view of a curtain in accordance with another embodiment of the present invention.

Referring to FIG. 6, there is shown generally at 70 an alternative embodiment of the curtain wherein two curtain sheets 72 are integrally or otherwise suitably attached (as a unit) side-by-side along their respective upper marginal portions 77 to sleeve 61 which, like in FIG. 5, is received on curtain rod 54 which in turn is attached to the upper frame 14 and has the fastener elements 30 attached thereto. Curtain sheets 72 are otherwise similar to curtain sheet 62. In order to arrange the curtain in a desired pattern, one or more of the fastener elements 32 as desired are raised and attached to one or more of the fastener elements 30 similarly as previously discussed with respect to FIGS. 1 to 3. Behind the curtain sheets 72 (as well as behind curtain sheets 10 and 62) may be provided a sheer panel 78 (or panel of other suitable material and which may, if desired, be split) sewed or otherwise suitably attached to the sleeve 52 (or to fastener elements 30 or otherwise to the upper frame for the sheets 10).

Figure 10:
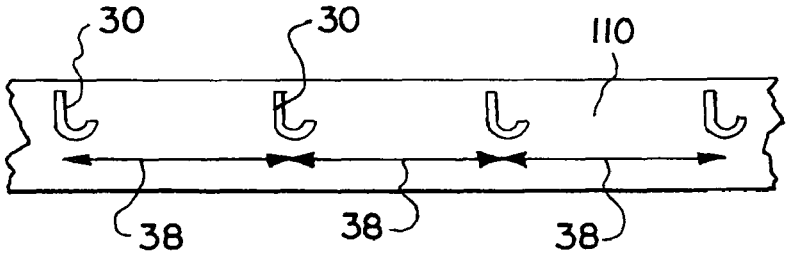
FIG. 10 is a side view of a header with fastener members attached for hanging of the curtains in accordance with another embodiment of the present invention.

Referring to FIG. 10, there is shown at 110 a header, made of wood, plastic, metal, or other suitable material, which may be screwed or otherwise suitably attached to an upper window frame or other structural member and which supports the fastener members (hooks) 30 which may be molded thereto or screwed or otherwise suitably attached thereto. The header 110 may be suitably decoratively-shaped.

Figure 11:
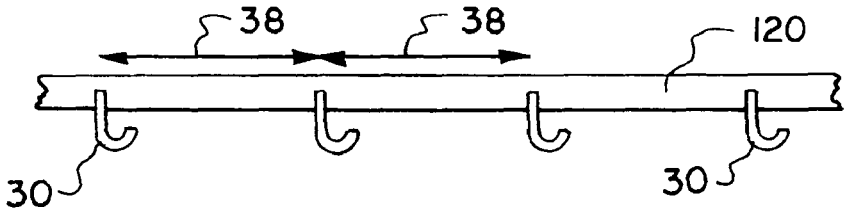
FIG. 11 is a view similar to that of FIG. 10 of a curtain rod with fastener members attached for hanging of the curtains in accordance with another embodiment of the present invention.

Referring to FIG. 11, there is shown at 120 a curtain rod, made of plastic or other suitable material and which may also be decoratively-shaped, which supports the fastener members (hooks) 30 which may be molded thereto or clamped or otherwise suitably attached thereto.

Figure 12:
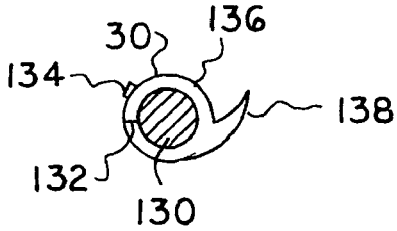
FIG. 12 is a cross-sectional view of a conventional curtain rod with fastener members attached for hanging of the curtains in accordance with another embodiment of the present invention.

Referring to FIG. 12, there is shown at 130 a conventional curtain rod on which the fastener members (hooks) 30 (one shown) are received, thereby transforming a conventional curtain rod for use with the curtains 10. The hooks 30 may be composed of plastic or other suitable material and have the form of clamps (split such as at 132) wherein they are slid over the length of the rod 130 into position then clamped in position such as by screw 134 or other suitable means. The hook portions 138 are formed (molded) integral with the clamp portions 136 or otherwise suitably attached thereto.

Figure 24:
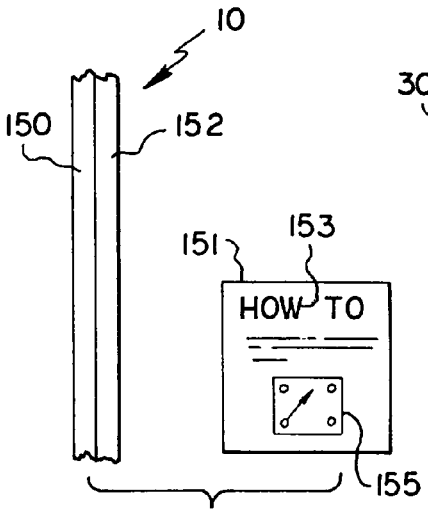
FIG. 24 is a partial enlarged edge view of a curtain sheet of FIG. 1 and a plan view of a printed instruction sheet for forming a pattern.

While the curtains themselves may be marketed, directions can also be sold, especially for the do-it-yourself person, on how to make a panel, including directions on sizes and where to strategically place holes or other fastener elements and other items. This would desirably allow consumers to use the fabric of their choice. Such instructions may be marketed with the curtains 10 in a package as part in a kit or on a website with instructions in the package for accessing the website, or marketed separately in a book or a pattern. Thus, as illustrated in FIG. 24, the kit may comprise one or more curtain sheets 10 and one or more printed instruction sheets, illustrated at 151, providing instructions, illustrated schematically at 153, which may include one or more diagrams, illustrated schematically at 155, for forming one or more of the patterns or instructions for accessing a website which provides such instructions. By "instructions" is meant to include printed "patterns."

A printed pattern, such as illustrated at 151 in FIG. 24, or set of instructions, whether sold separately or as part of a kit or provided over the internet, includes information regarding locations of fastener elements in a structural member and in a curtain sheet and including positioning thereof along and adjacent the sheet perimeter in a quantity and spacing over the entirety of the sheet perimeter to be attached to respective ones of the structural member fastener elements for hanging various other edge portions of the sheet from the structural member so that the curtain can be hung by the customer in a variety of alternative patterns, the printed pattern or set of instructions further including illustrating attaching of sheet fastener elements to structural member fastener elements for hanging one edge portion of the sheet from the structural member and illustrating attaching of sheet fastener elements to structural member fastener elements for hanging at least one other edge portion of the sheet from the structural member. The printed pattern or set of instructions may include panel sizes, spacings of holes, and other information needed to form a desired pattern. The customer may then duplicate the printed pattern with a curtain 10 hung from a structural member. It should be understood that the pattern may be a template upon which cloth is placed for cutting out a panel.

Figure 9:
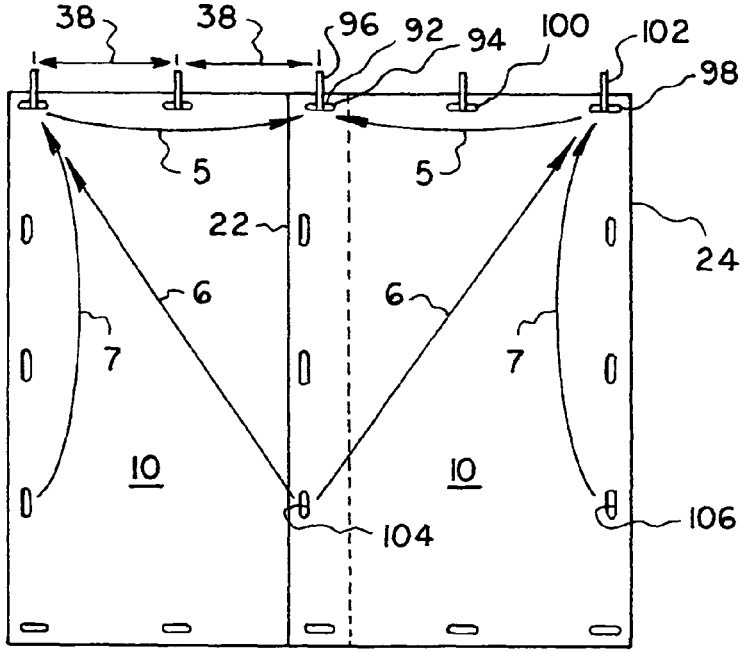
FIG. 9 is a front view of the curtain sheets of FIG. 8.

FIG. 8 illustrates generally at 90 another example (a more exotic example) of one of the multitude of decorative/functional patterns that can be achieved with the curtains of the present invention. FIG. 9 illustrates the sequence involved in forming the pattern, beginning with the two panels being hung from pins 30 in an overlapping relation wherein the upper right hole 92 of the left panel and the upper left hole 94 of the right panel sharing the middle pin 96. The sequence for the right panel will now be described, it being understood that the sequence for the left panel is a mirror-image thereof. First, the panel is folded over itself to bring outer side edge 24 next to inner side edge 22, then pin 96 received in hole 94, as illustrated by arrow 5. As apparent in FIG. 9, if the spacing between holes 94, 98, and 100 were unequal, either the hole 98 could not reach the pin 96 for the pin 96 to be received therein or bunching would occur due to excess material. Thus, the equal spacing 38 is provided, as previously discussed, to effectively and aesthetically achieve the desired effect without excess material hanging around the window frame 14 in an unsightly manner. Finally, pin 102 is received in holes 104 and 106, in either order, as illustrated by arrows 6 and 7 respectively. It is thus apparent, as previously discussed, that by connecting the fastener elements 30 and 32 in various other combinations, a multitude (in the hundreds) of alternative decorative/functional curtain patterns, in the nature of origami, may be desirably achieved.

Referring to FIGS. 14 to 17, there is shown at 200 a preferred embodiment of a fastener element (for use in a kit or as a separate item) for use on a window frame 14 or other header for hanging a panel 10 (two portions 202 and 204 of the same panel illustrated, although two different panels may be hung from the same fastener element such as illustrated in FIG. 1). The fastener element 200 is a nail, made of steel or other suitable material, which is formed to allow portion 205 thereof to be easily driven (hammered) into the frame 14 so that the protruding portion 206 is inclined upwardly at a small angle, illustrated at 208, of, for example, between about 15 and 45 degrees, to serve as a hook for receiving the holes 32 so as to better anchor the nail and to better hold the curtains thereon. It should be understood that it need not be angled at all. Integrally formed (or otherwise suitably connected) with the nail or hook 200 intermediate its ends (for example, about half way there between) is a thin disc 210 which is inclined relative to the nail axis at the same angle 208. This allows the nail 200 to be driven into the frame 14 until the disc 210 is flush with the surface of the frame 14 thereby orienting the protruding nail portion 206 at the desired upwardly inclined small angle 208 so that it is retained securely at that angle so that it can suitably and securely serve as a hook for receiving the panels 10 without the panels sliding off. The nail 200 may alternatively be used for hanging picture frames or plates and the like.

The outer end segment 212 of the protruding portion 206 is threaded with threads 224 to securely receive decorative cover or knob 34 or other suitable accessory or cap (which may or may not be hollow and may be of any suitable shape and size) for receiving segment 212 and which has a facing portion 214 with a threaded aperture 216 to threadedly receive the threaded segment 212, with the segment being received to extend past the facing portion 214. The decorative members 34, in addition to aesthetically finishing off the pattern, may also serve to maintain the panels on the hooks 200. The decorative members 34 can then be easily unscrewed for changing the origami pattern or for changing the decorative member 34.

In order to protect the fabric 10 from becoming frayed or ripped from its contact with threads as it is often being hung and taken down and re-hung as the variety of origami patters are developed and changed over time and as the fabric rests on the hooks, the inner segment 218 of the protruding portion 206 is preferably left un-threaded, i.e., to provide a smooth portion on which the fabric may rest so as to reduce fraying of the fabric 10 with friction from the threads. In order to further protect the fabric 10 during installation/changing of origami-like patterns even from fraying or ripping on the threads 224, the threaded segment 212 may be threadedly received in a threaded axially-extending bore, illustrated at 222, of a protective sleeve 220 (i.e., the sleeve 220 screwed on the segment 212), composed of plastic or other suitable material, during such installation/changing of origami-like patterns. It should be understood that the hooks 200 may be used without the decorative members 34 or accessories, in which event the screw-on washers 220 may be left on the hooks 200. Alternatively to the sleeve 220, a cap 260 made of, for example, hard plastic suitable for withstanding hammering, with a cap portion 262 to cover the terminal end of the segment 212 with the bore 222 terminating at the cap portion 262, may be provided to protect the threads 224 during such hammering.

In order to, in an alternative way, protect the threads 224 of the segment 212 while the hook 200 is hammered into position, a protrusion 226, which has a smaller diameter than the inner diameter of the threads 224, extends outwardly from the hook end to serve as contact for the hammer, i.e., so that the hammer does not contact and thereby damage the threads 224.

The hook 200 may, for example, be sized to hold 40 to 60 pounds, have an overall length of about 1½ to 2 inches, have a protruding portion length, illustrated at 226, of about ¾ inch, and have a disc 210 diameter of about ½ inch, it being understood that the hook 200 may be otherwise suitably shaped for its specific application.

It should of course be understood that various other suitable fastener items, such as suction cups on glass, decorative hooks, magnets, Velcro material, may be used to attach the fabric 10 to a window frame, wall, or other surface, and such other fasteners are meant to come within the present invention.

Figure 18:
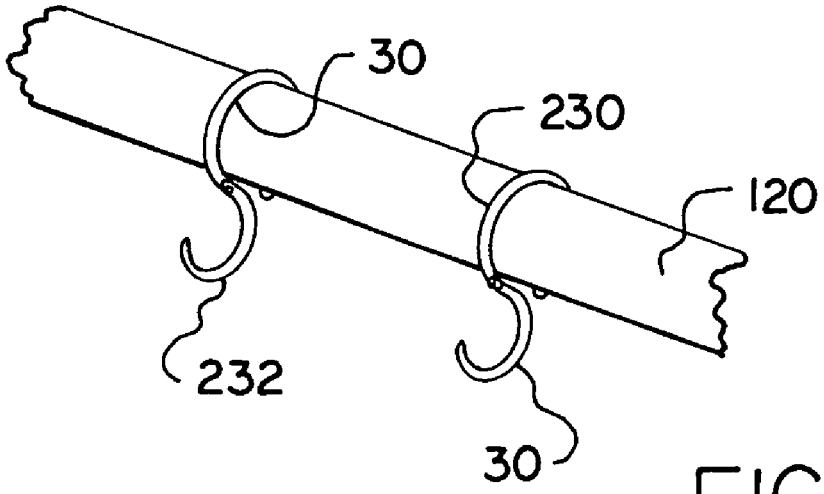
FIG. 18 is a partial schematic view of a curtain rod with one embodiment of the hooks of FIG. 11 for hanging the panels.
Figure 19:
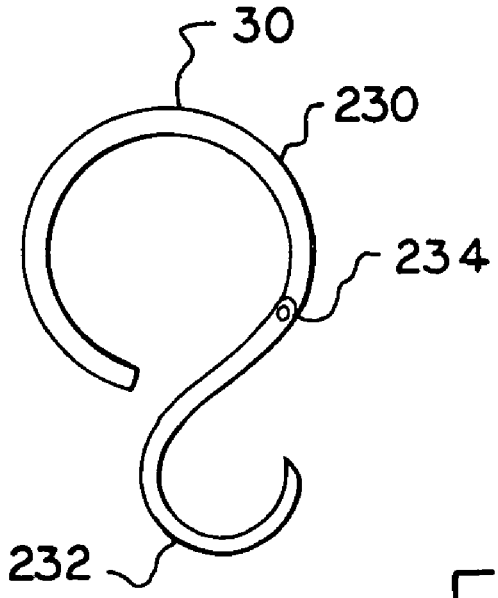
FIG. 19 is an enlarged schematic illustration of one of the hooks of FIG. 18.

Referring to FIGS. 18 and 19, the hooks 30 (see FIG. 11, wherein they are schematically shown) are shown to be hinged "S" clamp hooks each comprising a portion 230 which wraps around the curtain rod 120 to be secured thereto and a portion 232 which is shaped to serve as a hook for the fabric 10. The portions 230 and 232 are suitably connected by a hinge, illustrated at 234, in a conventional manner commonly known to those of ordinary skill in the art to which the present invention pertains, which allows the hook 30, with application of suitable force, to "clamp" onto the curtain rod 120. It should of course be understood that the hooks 30 may be otherwise shaped and embodied, and such other embodiments thereof are meant to come within the present invention.

Figure 20:
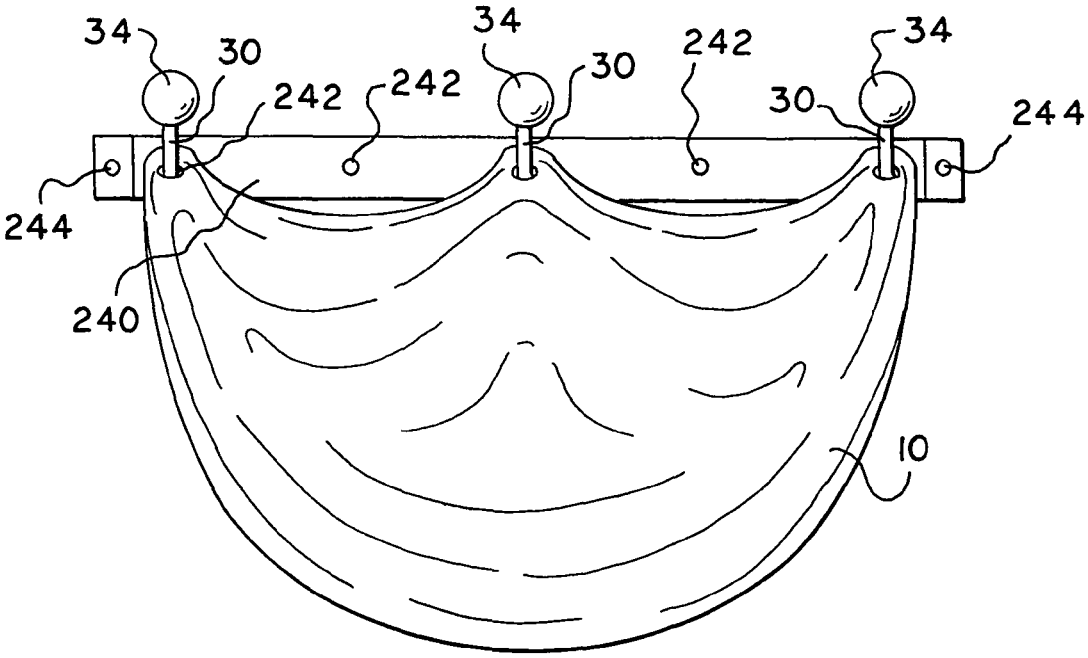
FIG. 20 is a schematic view of a header with the curtains attached.

Referring to FIG. 20, there is shown at 240 a fastener strip for hanging of the origami curtains 10. The fastener strip 240, which may be part of a origami pattern kit or provided separately, has over its length a plurality of pre-spaced apertures, illustrated at 242, which may, for example, be pre-threaded for receiving the threaded fastener elements 30. Similarly as the hooks 200, the fastener elements 30 (as well as other fastener elements described in this specification) may be provided without threads over portions thereof on which the fabric 10 is placed and rested to prevent or reduce fraying and ripping thereof. The fastener strip 240 may be attached to a supporting structure by suitable means such as, for example, by screws threadedly received in threaded or un-threaded apertures, illustrated at 244, in the fastener strip end portions and screwed into the supporting structure. The fastener strip 240 may be painted the same color as the color of the wall or supporting structure to which it is attached to blend in or it may be suitably made to be more decorative. The apertures 242 are spaced so as to provide flexibility of placement of the fastener elements 30 along the fastener strip 240 as desired. Similarly, a curtain rod, such as curtain rod 120 in FIG. 11, may be adjustable and provided with pre-spaced apertures, which may, for example, also be pre-threaded for receiving the fastener elements 30, i.e., each of the fastener elements 30 in FIG. 11 being received in apertures (not shown) which are pre-threaded and pre-spaced in the curtain rod 120.

The fastener strip 240 may be extendible to fit different widths of windows (for example, 24 to 48 inches or, for another example, 48 to 78 inches) or may, if desired, be non-extendible. An example of a suitable fastener strip 240 is an extendible Dauphine pocket rod sold by Spring Window Fashions LLC of Middleton, Wis. Another example of a suitable fastener strip 240 is an extendible pocket rod illustrated in U.S. Pat. No. 5,480,040, which is incorporated herein by reference. Such pocket rods may be suitably composed of a suitable metal and may be provided to be extendible by a pair of slidably engaged telescoping rod members (illustrated at 24 and 26 in the aforesaid U.S. Pat. No. 5,480,040) attached to end brackets (illustrated at 40 in the aforesaid U.S. Pat. No. 5,480,040) respectively. In order to provide the apertures (242 in FIG. 20), they are provided as apertures in both rod members which are suitably spaced to align or match (for example, on 6 or 12 inch centers) to allow insertion of fastener elements 30 when extended to desired pocket rod widths, using principles commonly known to those of ordinary skill in the art to which the present invention pertains. Alternatively, other suitable means such as, for example, Velcro material or snaps, may be used for attaching the curtain 10 to the pocket rod 24. Fabric may be, if desired, aesthetically gathered evenly over the pocket rod and end brackets, as suggested in instructions for the Dauphine pocket rod.

Figure 55:
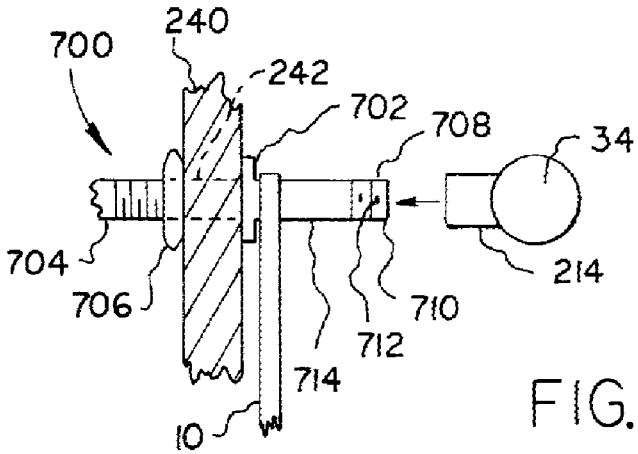
FIG. 55 is a side view of a stud and decorative knob assembly in accordance with the present invention for hanging the panels, illustrated attached to a header shown in section.

Referring to FIG. 55, there is shown at 700 a preferred embodiment of a fastener element (for use in a kit or as a separate item) for use with pocket rod 240 or otherwise on a window frame 14 or other header for hanging a panel 10. The fastener element 700 is a stud, made of steel or other suitable material, which has an enlarged diameter thin disc portion 702 intermediate its length for engaging the inner surface of the pocket rod 240 for providing stability. The stud 700 has a threaded portion 704 suitably receivable in the aperture 240 and which is suitably engagable by a wing nut 706 or other suitable fastener for securely attaching the stud 700 to the pocket rod 240. The other end portion 708 of the stud 700 is, similarly to the nail portion 212 (FIG. 14), provided with an outer end segment 710 which is threaded with threads 712 to securely receive decorative cover or knob 34 or other suitable accessory or cap (which may or may not be hollow and may be of any suitable shape and size) wherein the facing portion 214 with the threaded aperture 216 threadedly receives the threaded segment 710, with the segment being received to extend past the facing portion 214. The decorative members 34, in addition to aesthetically finishing off the pattern, may also serve to maintain the panels on the hooks 700. The decorative members 34 can then be easily unscrewed for changing the origami pattern or for changing the decorative member 34.

Figure 22:
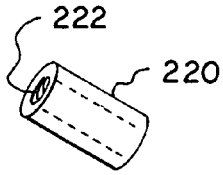
FIG. 22 is a perspective view of a protective cover for the threaded portion of the hook of FIG. 14.
Figure 15:
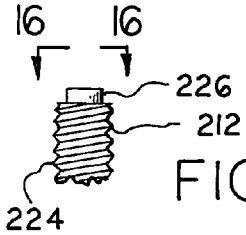
FIG. 15 is a partial view of an end portion of the hook, taken along lines 15-15 of FIG. 14.
Figure 16:
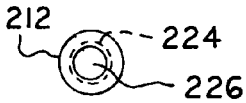
FIG. 16 is an end view of the end portion of the hook, taken along lines 16-16 of FIG. 15.
Figure 17:
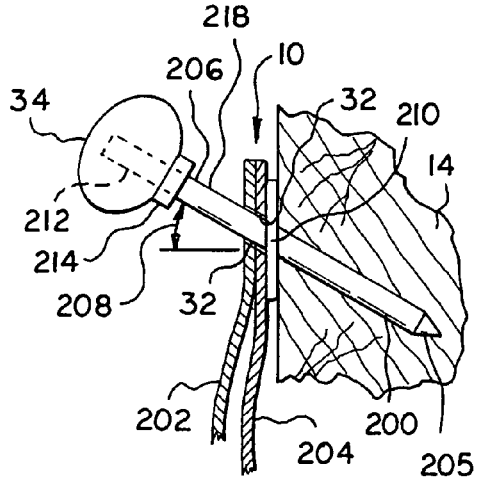
FIG. 17 is a side view of the hook illustrating it driven into a wall and with panels hung thereon, the wall and panels shown in section.
Figure 23:
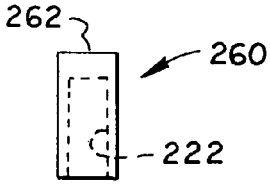
FIG. 23 is a side view of an alternative embodiment of the protective cover.

In order to protect the fabric 10 from becoming frayed or ripped from its contact with threads as it is often being hung and taken down and re-hung as the variety of origami patterns are developed and changed over time and as the fabric rests on the hooks, the inner segment 714 of the protruding portion 708 is preferably left un-threaded, i.e., to provide a smooth portion on which the fabric may rest so as to reduce fraying of the fabric 10 with friction from the threads. In order to further protect the fabric 10 during installation/changing of origami-like patterns even from fraying or ripping on the threads 712, the threaded segment 710 may be threadedly received in the threaded axially-extending bore 222 of the protective sleeve 220 (FIG. 22) or cap 260 (FIG. 23), i.e., the sleeve 220 or cap 260 screwed on the segment 710 during such installation/changing of origami-like patterns. The stud 700 may be similarly sized and shaped, as suitable and applicable, as the hook 200.

Figure 21:
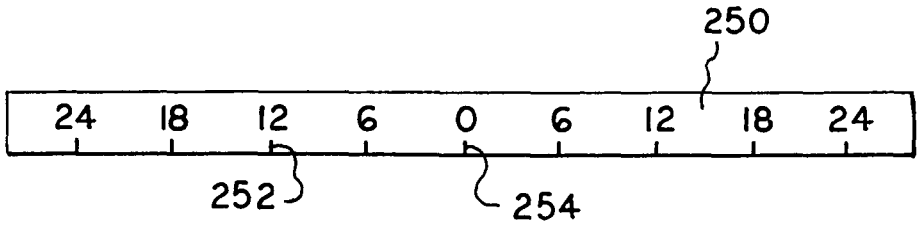
FIG. 21 is a plan view of a measuring strip used for attaching the hooks on a header.

An origami pattern kit may also contain a strip, illustrated at 250 in FIG. 21, which has ruled markings, illustrated at 252, and which may be applied to a wall or header to aid in determining locations for mounting of fastener elements 30. The strip may contain adhesive tape or the like at its ends for applying it to the wall or it may comprise masking or other suitable tape on which the ruled markings 252 have been applied or otherwise suitably formed. For example, the ruled markings may indicate a center point, illustrated at 254.

Figure 25:
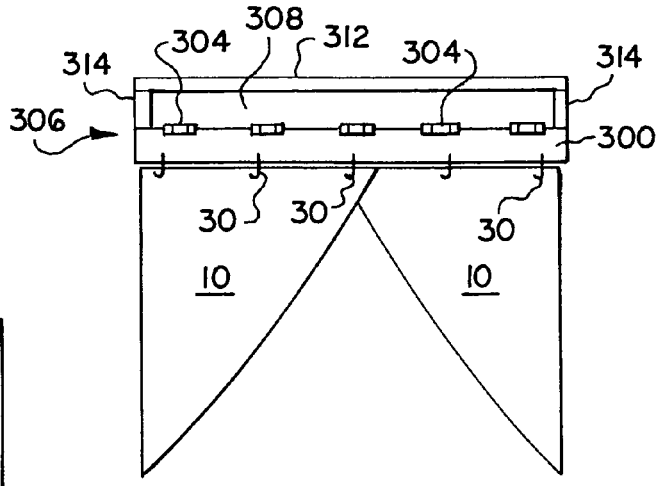
FIG. 25 is a front view of an opened hingedly attached cover member for an installation strip, illustrating hanging of curtains therefrom.
Figure 27:
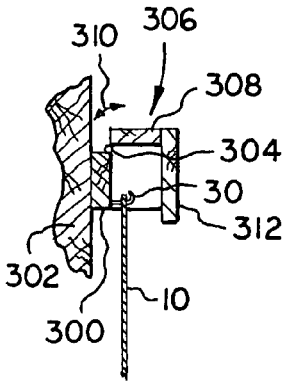
FIG. 27 is a sectional view taken along lines 27-27 of FIG. 26.
Figure 26:
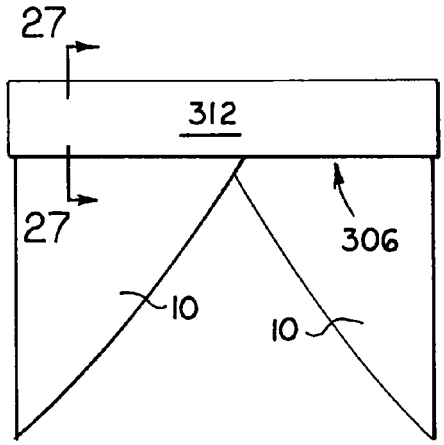
FIG. 26 is a front view of the installation strip shown with the cover member in a closed position covering the installation strip with the curtains hanging therefrom.

Referring to FIGS. 25 to 27, in order to allow the user easy access to the hooks 30 for changing the pattern of the curtain panel or panels 10 while also allowing the hooks 30 to be concealed for a clean finished look, a header 300, to which is connected the hooks and which is suitably attached to a structural member 302, is suitably hinged, as by hinges illustrated at 304, or otherwise suitably connected to a cover structure, illustrated generally at 306, as follows. Cover structure 306 includes a rectangular (or otherwise suitably shaped) member or panel 308 hinged connected by hinges 304 to header 300 for hinged movement, as illustrated at 310, between a vertical orientation as illustrated in FIG. 25 and a horizontal orientation as illustrated in FIG. 27. Suitably connected to the outer or upper edge of member 308 to hide the outer or upper edge and normal to member 308 is a rectangular (or otherwise suitably shaped) cover member or panel 312 to be oriented vertically in front of the header 300 when in the closed position of FIGS. 26 and 27 to conceal the header 300 and hooks 30 for a clean finished look. By rotating the cover structure 306 upwardly, as illustrated at 310, the cover structure 306 is moved into the open position of FIG. 25 with the cover member 312 oriented horizontally so that the curtain pattern may be easily changed. The ends of the cover structure 306 are suitably enclosed by suitable panels or side returns 314 to enhance the pleasing finished appearance from the ends. The cover structure 306 as well as the header 300 may comprise suitable decorative moldings or the like and may be made of metal, plastic, wood, or other suitable material. It should of course be understood that other suitable cover structures may alternatively be provided. For example, a suitable cover structure may be provided for a curtain rod. For another example, the cover structure may be provided with brackets and formed to be extendible to fit various size (lengths) headers 300.

Figure 28:
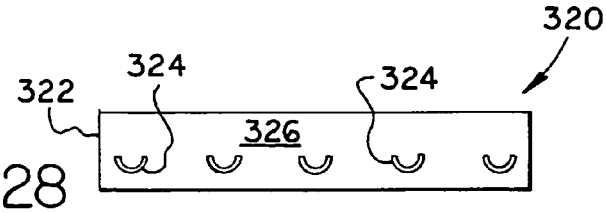
FIG. 28 is a rear view of an alternative cover for the installation strip.

An alternative cover structure, illustrated generally at 320 in FIG. 28, for the header 300 and hooks 30 comprises a rectangular piece of cloth 322 with cloth loops 324 sewn or otherwise suitably attached to the rear (non-facing) side 326 thereof, the opposite side (not shown) to provide a pleasing clean finished appearance.

Figure 29:
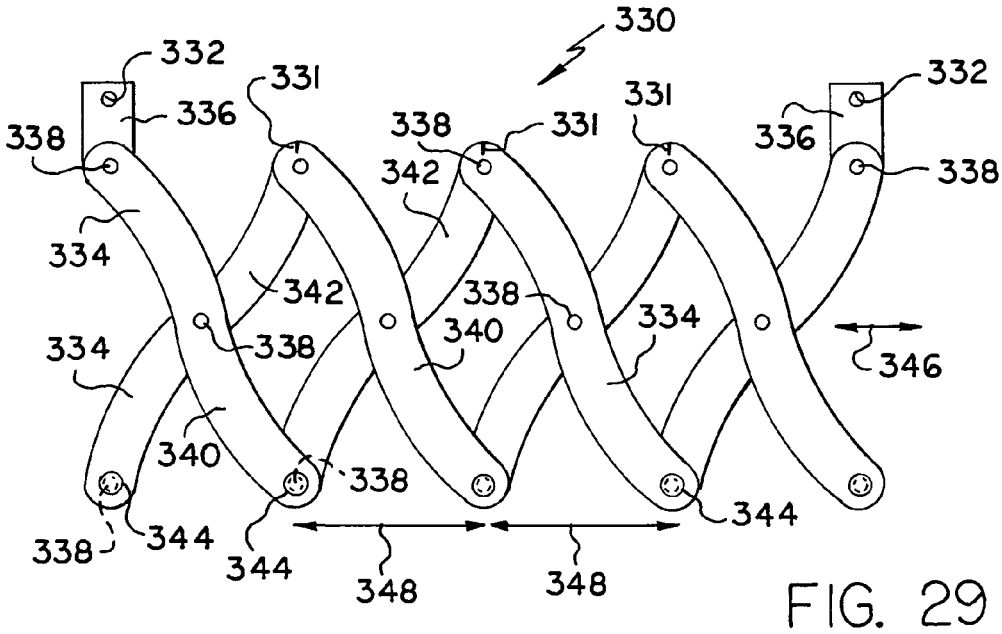
FIG. 29 is a front view of an alternative installation strip.

An alternative hanger rod or structure is illustrated generally at 330 in FIG. 29 wherein the hanger rod is attachable, for example, via holes, illustrated at 332, at its ends and is length-adjustable (for example, distance between the holes 332). The hanger rod 330 is composed of a structure which is considered to be conventional for other purposes and which comprises a plurality of thin elongate narrow plates 334 (for example, about 1/16 inch thick, about 9/16 inch wide, and about 5 to 6 inches long) of metal or other suitable material interconnected as described hereinafter in a manner to length-wise fold and unfold similarly as an accordion, the upper ends of the outer plates 334 connected to plates 336, as by rivets 338 or other suitable means, which contain the attachment holes 332. Viewed from left to right in FIG. 29, the plates 334 include a plurality of generally parallel downwardly slanting plates 340 and a plurality of generally parallel upwardly slanting plates 342, wherein (with the exception of the ends) each downwardly extending plate 340 is riveted, as by rivets 338, or otherwise suitably connected (to allow relative movement between plates) at both ends to respective ends of upwardly extending plates 342 and wherein each pair of crossing plates 340 and 342 is also riveted, as by rivets 338, or otherwise suitably connected (to allow relative movement between plates) at their centers. The lower rivets or connectors are formed to have hook portions 344 for hanging of a curtain 10. The hook portions 344 may be if any suitable shape, for example, outwardly (toward the viewer of FIG. 29) extending extensions of the respective rivets terminating in enlarged portions. The rivets 338 are accordingly geometrically symmetrically spaced so that, when the ends are stretched or squeezed to lengthen or shorten the hanger rod 330, as illustrated at 346, the distances, illustrated at 348, between adjacent hooks 344 remains equal or even, i.e., the distances 348 being equal to each other so that the curtain patterns may be easily formed no matter whether the curtain rod 330 is lengthened or shortened. Decorative knobs or the like may of course be applied to the hooks 344.

The upper rivets 338 may alternatively or instead be provided with the hook portions 344 thereby to allow the structure 330 to be hidden. The structure 330 may alternatively be attachable to an existing curtain rod.

The accordion-like structure 330 may alternatively (or also) be used as a measuring device for accurately marking off equally spaced locations for hooks 30 for a desired length. Thus, members 340 may be provided with marks, illustrated at 331, at their upper ends (alternatively the lower ends of members 342) for marking locations for hooks 30, when members 336 are positioned at the ends respectively of the length to be divided into equal increments for placement of the hooks 30.

Figure 30:
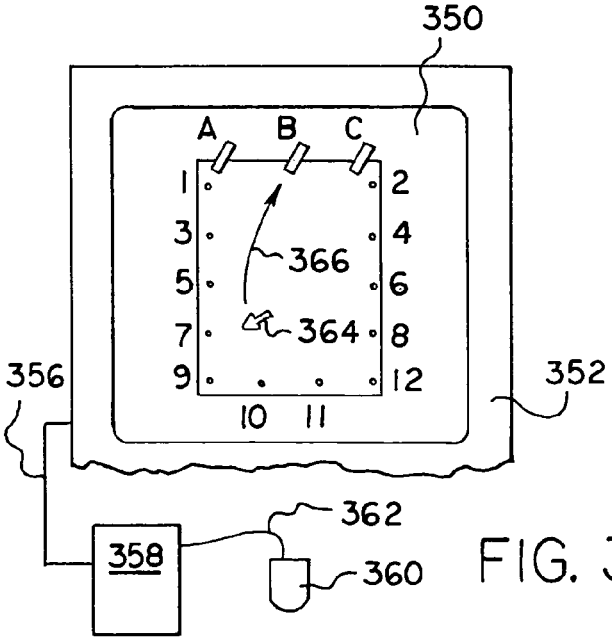
FIG. 30 is a front view of a computer monitor screen illustrating the use of a computer program for designing various origami patterns.

It is considered desirable to give the user the ability to test out the appearance of a new pattern on a computer before the curtains 10 are actually hung. In order to do so, a computer program is provided for use as illustrated in FIG. 30, wherein such a program can be developed using principles commonly known to one of ordinary skill in the programming art who has knowledge of the present invention as contained herein. Utilizing such a program, the locations of the various curtain holes 32 are indicated by numerals 1 to 12 and the locations of the various hooks 30 are indicated by letters A, B, and C on the screen 350 of a conventional computer monitor 352 suitably connected, as by line 356, to a conventional general all-purpose personal or other suitable computer 358 which suitably contains the program. The program may be provided to initially show a curtain 10 on the screen 350 in a starting position, as illustrated in FIG. 30. In order to use the program, the user utilizes a conventional mouse 360 suitably connected, as by line 362, to the computer 358, to move the associated curser 364 on the screen 350 to a selected numbered or flagged hole 32, i.e., to the number 7 representing a hole as seen in FIG. 30, then "drag" or "lift" it, as commonly known and as illustrated at 366, to a selected hook 30, i.e., to the letter B representing a hook as seen in FIG. 30, thus "picking up" the curtain at the selected "hole" and attaching it to the selected "hook". Alternatively, other means of "dragging" or "lifting" such as a touch screen and pen and Blackberry device may be used. The program is written and installed, in accordance with principles commonly known to those of ordinary skill in the art, to interactively show what the appearance of the actual curtain 10 would be when its actual hole 32 at position 7 thereof is connected with the actual hook 30 at position B. The program may also include the size/width of the window/curtain and show various options for the particular size window/curtain. Such a program and process is thus provided to advantageously allow the user to experiment with different patterns until he or she comes up with one that he or she wishes to implement, then save it to a file, and then physically put it up on a window. The program may also be pre-written with different codes/formulas for the user to try on the computer.

Figure 31:
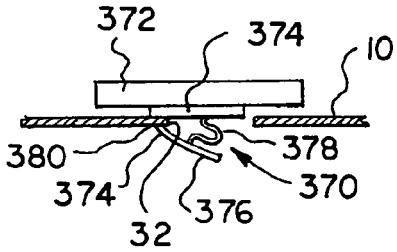
FIG. 31 is a side view of a clip illustrating its covering of a curtain hole, shown in section.
Figure 32:
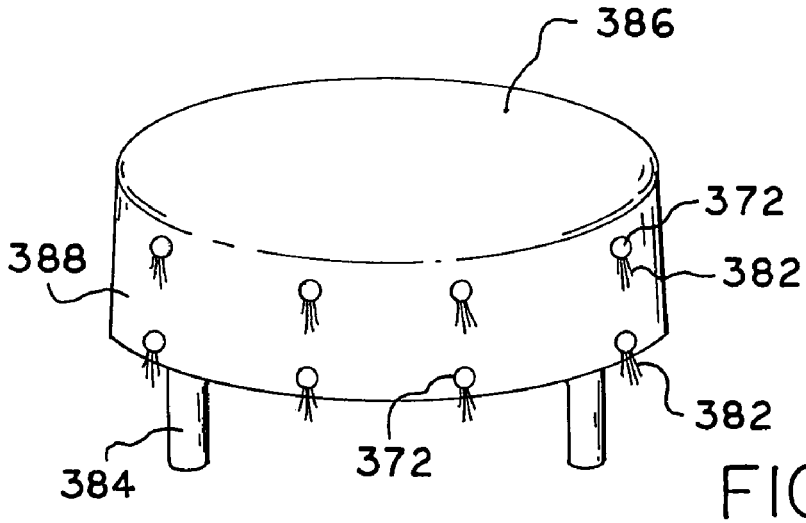
FIG. 32 is a perspective view of a table covered by a table cloth and illustrated with decorations.

Illustrated generally at 370 in FIG. 31 is a conventional decorative clip which is conventionally used for various other purposes but which is shown in FIG. 31 clipped within a hole 32 to decoratively hide the hole 32. The clip 370 includes a decorative button 372 (or other accessory, which may, for example, include a tassel) for positioning to face the viewer and to decoratively overlie and hide the hole 32 from view, as seen in FIG. 31, the clip 370 being provided to be easily adjusted so that the button hole 32 is covered. The clip 370 has one arm 374 suitably attached to the underside of the button 372, a second arm 376, and a spring 378 suitably connecting the arms and biased to close the clip 370, the clip 370 being opened by pressing arm 376 toward the button 372 against the force of the spring 378. In order to attach the clip 370 to decoratively cover the hole 32, an edge of the hole 32 is inserted between ends of the arms 374 and 376 with the clip 370 open and the arm 376 released to pinch the edge of the hole 32 between the ends of the arms 374 and 376, as illustrated at 380. The button 372 may come in various sizes and shapes and configurations and may, for example, have tassels 382 attached, as illustrated in FIG. 32, and may give appearance of being sewn on. Such a clip-on button or accessory may also be used to attach two or more button holes 32 together or attach different panels 10 together.

Referring to FIG. 32, there is illustrated at 384 a table having a table cloth 386, wherein the hanging edge portion 388 of the table cloth 386 is desirably strategically decorated with the buttons 372 in holes, similar to holes 32, thereof with the attached tassels 382. The buttons/tassels can be advantageously interchanged, either in the table cloth 386 or in the curtains 10, to provide a variety of decorative appearances.

It should of course be understood that many other panels/products other than table cloths and curtains may be decorated with the decorative buttons 372 attached to holes 32 or otherwise suitably attached. It should also be understood that, while the buttons 372 are shown to have decorative tassels 382, they may be otherwise suitably decorated.

For example, referring to FIGS. 42 and 43, there is shown generally at 500 an elongate cuff or napkin ring or fabric wrap 502 (shown unfolded in FIG. 42) made of cloth or other suitable material and having a hole 32 at each of its ends. As seen in FIG. 43, the cloth 502 is folded/shaped into the form of a cuff and held in that shape by a decorative clip or clip-on accessory 372 clipped to edges of both of the holes 32 thereby decoratively covering the holes 32, and a napkin 504 (made of, for example, fabric or paper) received within the decorative cuff 502.

Referring to FIG. 44, there is illustrated at 510 an alternative embodiment of the cuff wherein the cuff is shown to have its end edges sewn together, as by seam 512, into the cuff-shape and a decorative clip or clip-on accessory 372 clipped to an edge of a single hole 32 to decoratively cover the hole 32. It is of course understood that the cuff 510 may have more than one such hole 32.

Referring to FIG. 45, there is illustrated at 520 a folded napkin, made of cloth or other suitable material, and a decorative clip or clip-on accessory 372 clipped to an edge of a single hole 32 to decoratively cover the hole 32. It is of course understood that the napkin 520 may have more than one such hole 32. For example, FIG. 46 illustrates generally at 530 a napkin, unfolded, made of cloth or other suitable material, in accordance with an alternative embodiment wherein the napkin has four holes 32 at its respective corners, with decorative clips or clip-on accessories 372 clipped to an edge of one or more of the hole 32, clipped to two of the holes 32 in FIG. 46, to decoratively cover the holes 32. It should of course be understood that the napkins 520 and 530 may be made in any suitable shape such as, for example, square, rectangular, triangular, and circular.

Referring to FIG. 47, there is illustrated at 540 a lamp shade, attached to a suitable base 552 and made of fabric or other suitable material, and decorative clips or clip-on accessories 372 clipped to one or more edges of holes 32 respectively, which like other products described herein are strategically placed for aesthetic purposes to decoratively cover the holes 32. It is of course understood that the lamp shade 540 may have only one or any number of such holes 32. FIG. 47 shows the lower decorative clips 372 to have tassels 382 and the upper decorative clips 372 to not have tassels, it being understood that the shapes and styles of the decorative clips 372 may vary even on the same lamp shade or other product.

Referring to FIG. 48, there is illustrated at 550 a curtain fabric panel, having an upper sleeve 552 received on a curtain rod 554 and having any suitable desired length, in which one or more (two shown) button holes 32 are provided in which decorative clips or clip-on accessories 372 may be clipped to one or more edges of holes 32, as illustrated at 556. In order to vary the curtain pattern, two such holes 32 are shown placed near opposite edges so that the curtain edges may be drawn together and a single decorative clip or clip-on accessory 372 clipped to edges of both holes 32. It should of course be understood that the holes 32 may be otherwise strategically placed to achieve various pattern effects or achieve various decorative effects in the panel 550.

It should of course be understood that the decorative clips or clip-on accessories 372 may be similarly used with various other products such as, for example, garments, shirts, dresses, and purses.

Figure 33:
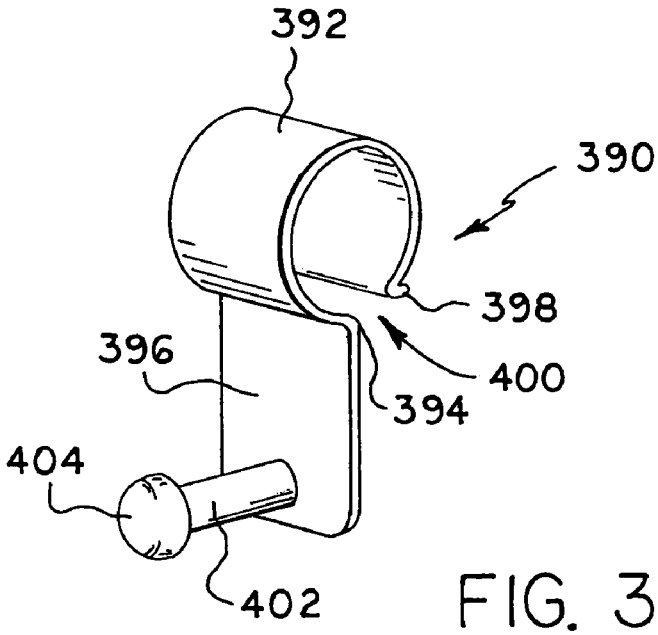
FIG. 33 is a perspective view of an alternative hook for receiving on a curtain rod.

As previously discussed with respect to FIG. 11, hooks 30 for the curtain rod 120 may be molded thereto or clamped or otherwise suitably attached thereto, and they may come in various sizes and configurations. Referring to FIG. 33, there is illustrated generally at 390 an exemplary hook made, for example, of suitably flexible plastic or other suitable flexible material (even wire with the ends dipped in clear vinyl to prevent sliding) that may be fitted over a curtain rod and sized for the rod diameter. The hook 390 includes a generally cylindrical portion 392 which extends from an edge 394 which connects to a planar body portion 396 in a manner to extend about a curtain rod and terminates in a terminal edge 398 which is spaced from edge 394, leaving a lower gap, illustrated at 400, whereby the cylindrical portion 392 may be flexed to fit over a curtain rod. The lower end of the body portion 396 suitably supports a rod 402 having an enlarged terminal end portion 404 for receiving a hole 32. The rod 402 may be threadedly engaged to the body portion 396 so that it is removable to customize the appearance thereof, with the cylindrical and body portions 392 and 396 respectively. The entire hook 390 may alternatively be one-piece. The cylindrical portion 392 may have a suitable rubber/vinyl liner to prevent sliding. The hook 390 may be clear or colored to match the curtain rod 120. For another example, a hook 30 may have a spring mechanism which tightens a vinyl strap onto the curtain rod 120 and a front pin to release or loosen. As previously discussed, these are just two examples of various kinds of hooks 30 that may be used for the curtain rod 120.

The curtains 10 may be provided with various accessories to create different appearances. Exemplary of these accessories are fabric tie-backs or straps, tie-backs with button holes for use with clip-on accessories, and straps (which may be fabric adjustable) with button holes.

The curtains 10 may be made in a variety of fabrics appealing to children for their bedrooms, for example, a two-layer fabric comprising a pastel striped layer and a soft yellow layer. The curtains 10 may be formed in shapes appealing to children, for example, a butterfly, flower, rainbow, boat, house, bat, elephant, and cat, using the same process and codes and instructions and the like as discussed elsewhere in this specification. Various clip-on accessories which are appealing to children may be added, for example, clip-on eyes, nose, stars, or sun to further enhance the creation. A "mini" Window Orgami toy curtain may be attached to a wall to teach children visual concentration, numbers, colors, shapes, letters, creativity, and fun, following simplified directions to make simplified patterns.

Figure 34:
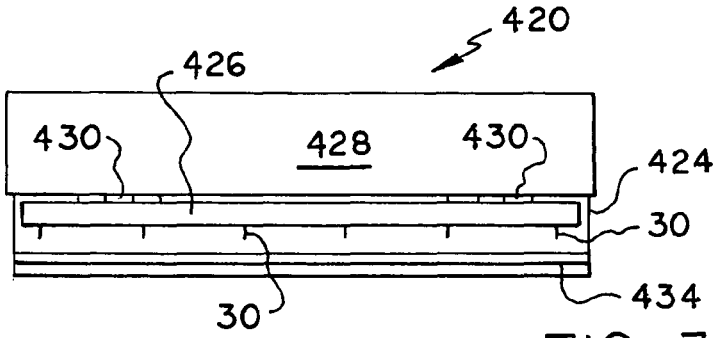
FIG. 34 is a front view of an opened hingedly attached cover member for an installation strip having hooks and a curtain rod.
Figure 35:
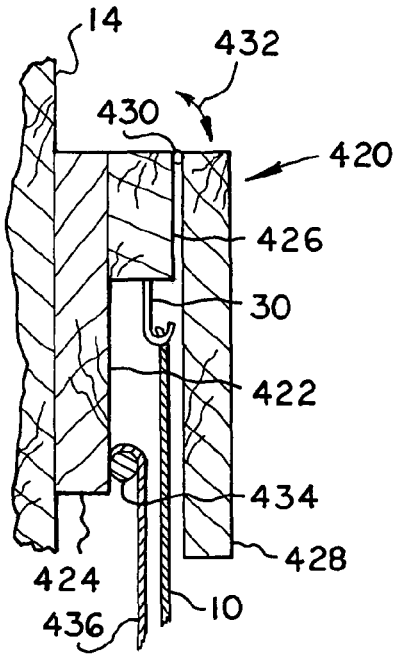
FIG. 35 is a sectional view of the installation strip and cover member of FIG. 34, illustrating hanging of curtains from the hooks and from the curtain rod.

Referring to FIGS. 34 and 35, there is illustrated generally at 420 an alternative embodiment of the header or installation strip 300 and hinged cover member 312 of FIGS. 25 to 27, wherein an installation strip or valence 422 comprises a first strip 424 suitably attached to the window frame or back board or other existing structural member 14 as by nails and a second strip 426 suitably attached to the first strip 424 as by nails. It should be understood that strips 424 and 426 may be a single member and may otherwise be suitably shaped. A cover member or valence cover 428, which may be suitably decorated to provide a pleasing appearance, is hingedly attached, by hinges 430, or otherwise suitably connected, to the upper forward edge of strip 426 to, in a first position shown in FIGS. 35 and 36, be oriented in front of the installation strip or support structure 422 and the hooks 30 to hide them from view, as illustrated in FIGS. 35 and 36, thus allowing limited or no access to the hooks 30, and to be hingedly raised upwardly, as illustrated at 432, to a second position illustrated in FIG. 34, wherein the support structure 422 and hooks 30 are uncovered (at least partially) to provide increased or easy access for hanging of curtains, similarly as cover member 312 is used in FIGS. 25 to 27.

It may be considered desirable to hang a sheer or other curtain or even another Window Origami curtain behind the Window Origami curtain(s) 10. In order to do so, in accordance with the present invention, a curtain rod 434 for a backing curtain 436 is suitably attached to the strip 424. It should of course be understood that the hooks 30 and curtain rod 434 may be otherwise suitable positioned than as shown, the cover member 428 desirably sized to extend downwardly beyond the curtain rod 434 to cover and hide from view the curtain rod 434 as well as the hooks 30.

Figure 36:
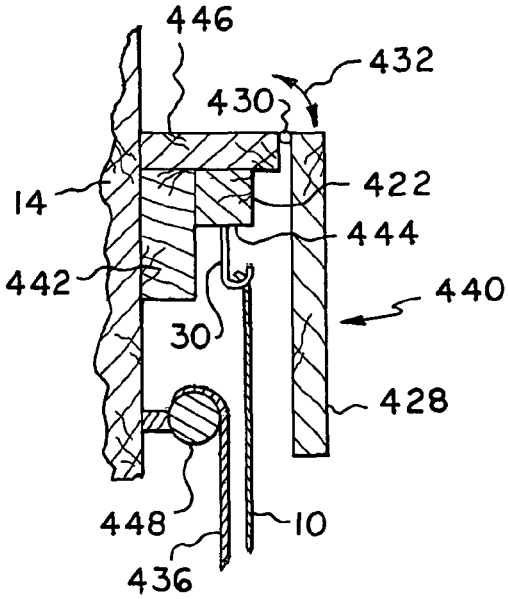
FIG. 36 is a sectional view of an installation strip having hooks and cover member and a pre-existing curtain rod, illustrating hanging of curtains from the hooks and from the curtain rod.

Referring to FIG. 36, there is shown generally at 440 an alternative embodiment of the installation strip/cover member arrangement wherein the installation strip 422 comprises strip 442 suitably attached as by nails to the structural member 14, a shorter strip 444 attached as by nails to the strip 422 forwardly thereof, and an overlying strip 446 suitably attached as by nails to strips 442 and 444 and structural member 14. It should be understood that strips 442, 444, and 446 may be a single member and may otherwise be suitably shaped. The hooks 30 are shown as attached to strip 444 to hang downwardly therefrom. The cover member or valence cover 428, which may be suitably decorated to provide a pleasing appearance, is hingedly attached by hinges 430, or otherwise suitably attached, to the upper forward corner of strip 446. A pre-existing or separate curtain rod 448 is shown attached directly to the structural member 14, thus forming no part of the installation strip/cover member arrangement. Thus, the installation strip 422 and cover member 428 are sized and mounted, as illustrated in FIG. 36, so that the curtain rod 448 as well as the hooks 30 and installation strip 422 are suitably covered and hidden from view. The cover member 428 extends downwardly beyond the hooks 30 and installation strip 422 a distance sufficient to also cover a typical pre-existing or mounted rod 448. For example, the structure 422 may be constructed so that hooks 30 extend downwardly beyond member 442 or the structure 422 may be constructed so that the pre-existing or mounted rod 448 is at the same height as the hooks 30. In any event, what is important is that the cover member 428 extend downwardly beyond the hooks 30 and installation strip 422 and be sized so that, when attached to the structure 14, it also covers (extends downwardly beyond) the pre-existing or mounted rod 448. FIG. 37 illustrates the aesthetically pleasing appearance which may be achieved by the hanging of the backing curtain 436 underneath a pair (or other number) of Window Origami curtains, with the hooks 30 and curtain rod 434 or 438 aesthetically hidden from view.

The rod 434 can be made of any suitable material such as, for example, wood, plastic, or string. The rod 434 can be a straight rod to accept a curtain with tabs, pocket, string, etc. or can also accommodate one or more Window Origami panels in which the button holes 32 can be threaded onto the rod 434. The rod 434 can also be a traverse rod so that the panels can be attached and opened and closed with a pulling mechanism. The panels can also be attached with a clip and ring or any other suitable devices for hanging a curtain from a rod. A blind or shade can also be hung, and the installation strip/cover member may be arched or otherwise suitably shaped.

The covered installation strip 422 may be constructed to fit various window shapes such as, for example, octagon, isosceles or right or other triangular, pentagon, square, trapezoid, oval, or round, as well as various window sizes, and the panels 10 and 436 may also be of various sizes and shapes. It should also be understood that the installation strip 422 and/or cover member 428 may be a pre-existing attachment to a window, i.e., built-in as part of the trim.

Referring to FIGS. 38 and 39, there is illustrated generally at 450 a panel which may be used instead of panel 10. Panel 450 comprises a piece 452 of rectangular (or otherwise suitably shaped) fabric to which is sewn (or otherwise suitably attached) to each of its perimetric edges 454 an individual elongate strip or tape 456 containing the holes 32 or other fastener elements. These individual strips 456 may be cut to the correct length from an elongate strip or tape 458 which may be of any desired length, and the holes 32 may be pre-sewn and pre-spaced therein. The tape may, for example, be sold in rolls or by the yard. Alternatively, the individual strips 456 can be pre-formed in the correct length for a cloth edge 454 or cut or pre-formed to extend all the way around the piece of cloth 452. The tape 458 as well as individual strips 456 may be made, for example, of fabric, lace, or ribbon. The tape 458 as well as individual strips 456 can be sold to be sewn (or otherwise suitably attached) by the customer to the fabric 452, thus turning an ordinary piece of fabric into a Window Origami panel for attaching the holes 32 to the hooks 30 and thereby forming literally hundreds of origami-like curtain configurations. The tape 458 as well as the individual strips 456 may be, for example, a decorative fabric to match the cloth 452 or otherwise suitably decorative.

Referring to FIG. 40, there is illustrated a panel 10 to which is sewn or otherwise suitable attached along each of its perimetric edges an elongate cover strip or flap 460, which may be suitably decorative to match the panel 10 or otherwise suitably decorative, sized width-wise for folding over along the sewn seam at 461 and suitably securing to the panel 10 such as, for example, by snaps, illustrated at 462, Velcro material, a Ziplock-like closure (as in typical Ziplock bags), or magnetic strips, to cover the holes 32 not in use at a given time for a more pleasing appearance. Where, for example, the curtain comprises strips 456 (FIG. 38), the flaps 460 (only one shown for illustrative purposes in FIG. 38) are sewn (or otherwise suitably attached) to the outer edges of the strips 456.

Referring to FIG. 41, there is illustrated generally at 470 a panel which may be used instead of panel 10. Panel 470 comprises the piece 452 of rectangular (or otherwise suitably shaped) fabric to which is spaced and attached along one or all of its perimetric edges 454 a plurality of detachable clips 472 to which are attached rings 474 containing the holes 32 or other fastener elements, which, as previously discussed, are used in to engage the hooks 30 or other suitable contact points or fastener elements to fold and configure the resulting panels 470 in the many origami-like configurations. Thus, a customer may purchase such clips separately for detachable attachment as desired to the cloth 452, or the cloth 452 may be sold with the clips attached. The clips/rings may be of a type currently known for use with drapery.

For example, for a typical window, the window treatment may comprise two panels, 25 inches wide by 48 inches long, allowing the Window Origami pattern to be changed quickly and easily, with no sewing required, with coded pattern instructions provided or with "create your own" patterns and with various installation options and the like, utilizing various decorative knobs and clip-on buttons and accessories, and upgrading or changing to other options/decorations, for virtually endless options for personalizing the finished look of the beautified Window Origami treatments, using the same panels. It should be understood that a window treatment may comprise one or more than two panels.

Accordingly, the fastener elements 32 are spaced along the perimeter of the curtain sheets, in accordance with the present invention as hereinbefore discussed, to effectively and aesthetically achieve a multitude of decorative/functional patterns in the nature of origami. It should of course be understood that the origami patterns in FIGS. 1 and 8 are merely illustrative, and certainly not exhaustive, of the myriad number, certainly well over a hundred, of patterns that can be conceived and applied using the principles of the present invention, with the user provided codes therefor or with the user creating his or her own designs. The curtains of the present invention are provided to be therapeutic (relaxing, fun, satisfying, and exercising) and to inspire creativity in the user. Once one becomes "hooked" with these Window Origami or Open The Window To Your Creativity curtains, he or she should never again be bored with the appearance of his or her curtains. These are Open the Window to Your Creativity window treatments.

Figure 49:
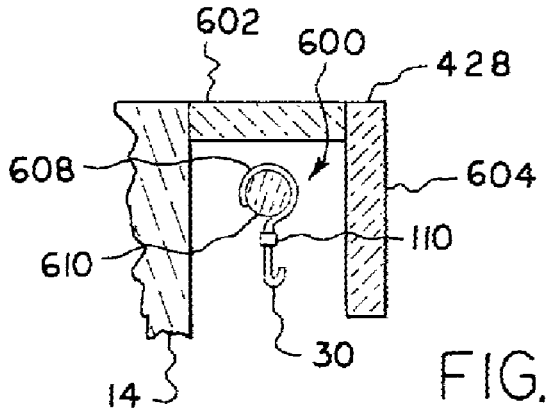
FIG. 49 is a sectional view of a curtain hanging system in accordance with an alternative embodiment, illustrated in a stowed position.

Referring to FIG. 49, there is shown generally at 600 a curtain hanging structure including installation strip or elongate structural member or fastener element support member 110 which has hooks 30 (or other fastener elements) attached to and spaced along the length thereof. These hooks 30 are hidden when in the out-of-the-way position, illustrated in FIG. 49, behind valence cover 428 (which is of course optional). The valence cover 428 comprises an upper horizontal member 602 suitably attached to upper window frame 14 or other existing structural member and a vertical member 604 suitably attached thereto and extending downwardly therefrom to hide the curtain hanging structure 600 from view. The installation strip 110 may, if desired, be suitably combined with a cornice.

As previously discussed, the Window Origami panels of the present invention are ones in which the user can follow simple "codes" or directions and change the hangings of the same panel(s) into a myriad of different decorative window treatment patterns. Each pattern can be created in literally seconds. The user can also "play" with the panels and create his or her own patterns. In a typical window installation, the user may have to climb on a ladder or the like to reach the installation strip with the hooks. This may be difficult for some people and may accordingly discourage them from changing the patterns as often as they may otherwise desire. In order to provide easy accessibility to the installation strip 110 and hooks 30 wherein they can be lowered to a comfortable desired height for hanging the panels in the various Window Origami patterns, in accordance with the present invention, the installation strip 110 is suitably mounted to the lower edge portion or lower edge 606 of a pull-down window shade 608. As is conventional, a pull-down window shade is wound on a spring-loaded roller 610 so that it can be unwound and pulled down and locked with its lower edge 606 in the lowered position illustrated in FIGS. 50 and 51, and with its upper edge, illustrated generally at 607, remaining at the upper position wherein it remains attached to the roller 610. It should be understood that, while the installation strip 110 is preferred, the hooks 30 can be otherwise suitably mounted to the lower edge 606. As previously discussed, the reference numeral 30 is intended to include other suitable fastener elements in addition to hooks, and screw-on decorative accessories may be added to the fastener elements 30. For example, the installation strip 110 may be made with a traditional curtain rod. The curtain rod may be attached or made to fit over an existing curtain rod, shade, blind, or the like. For another example, the installation strip 110 may be otherwise suitably embodied, for example, it may be a pocket rod, as illustrated at 240 in FIG. 20. The installation strip 110 can be attached to the lower edge 606 by any suitable means, for example, by wrapping the lower edge portion thereabout and sewing. The window shade 608 may be sold to customers with the installation strip 110 attached, or the installation strip 110 may be provided to customers for them to retrofit their existing window shades.

Such spring-loaded rollers 610 are conventionally and well known in the art. As is well known, the roller has a coil spring for raising the shade 608 from its lowered position, and a pawl is suitably mounted to lock the shade position in the desired pull-down position. Brackets at the roller ends are mounded to the insides of window stops. One bracket has a hole into which a round roll support is inserted, and the other bracket has a slot to receive a flat support at the opposite end of the roll. Since these features of a pull-down shade roll are conventional and well known in the art, they are not illustrated herein.

It is of course to be understood that the hardware used and the mounting for the roll and shade and installation strip should provide suitably secure attachment and be strong enough to hold the installation strip and the fabric panels 10 when attached. It should of course also be understood that, while a specific spring-loaded roll has been described, other suitable pulley systems may be used such as, for example, the means by which a Roman shade is pulled down or put up, or the means by which wooden blinds are put down or pulled up, or by means including the pulling of a string which rolls around a pole and pulls up the shade, or by a suitable motorized pulley system, or by means utilizing a metal or wire or string or chain or plastic or other suitable hinge system. If a string or rope or other pulling device is used, it may be set up to be secured to a wall when not in use to prevent accidents.

Figure 53:
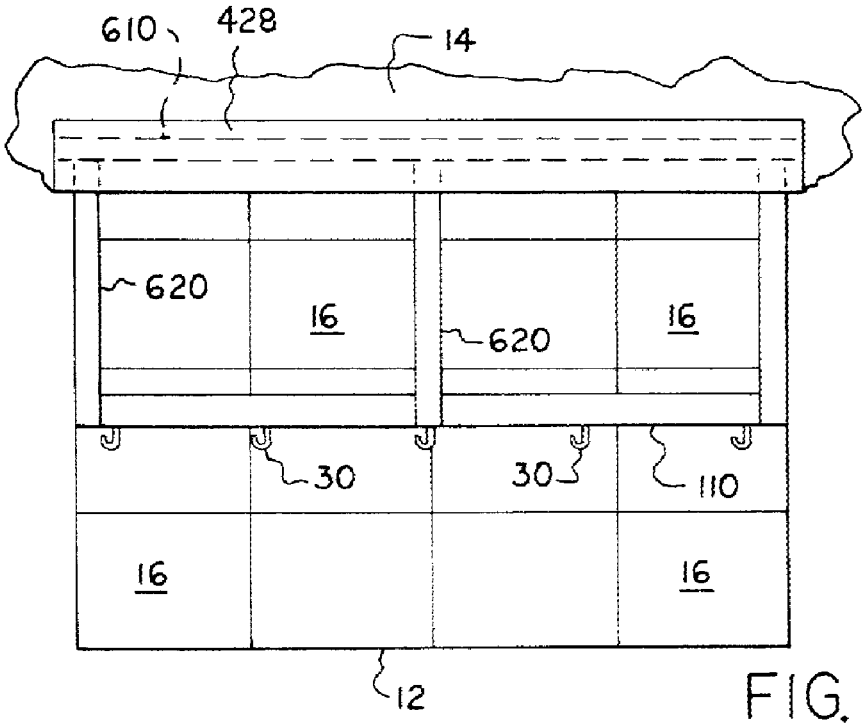
FIG. 53 is a view similar to that of FIG. 50 of an alternative embodiment of the curtain hanging system, illustrated in a position for hanging a curtain.
Figure 54:
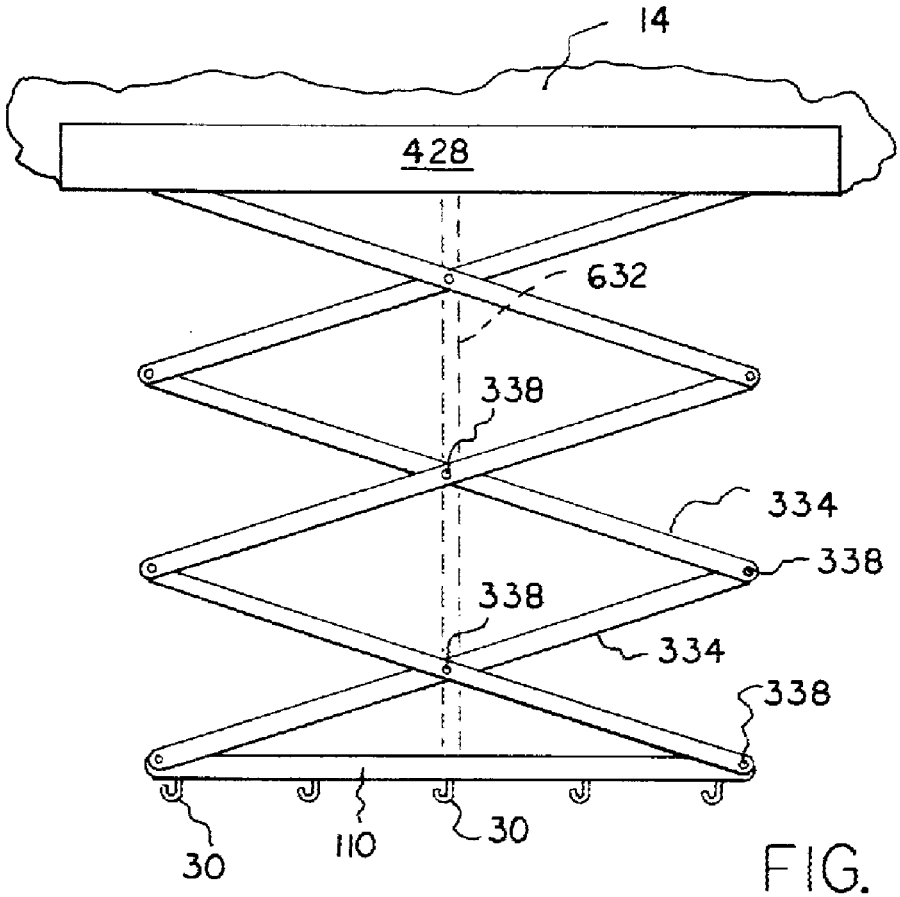
FIG. 54 is a view similar to that of FIG. 50 of another alternative embodiment of the curtain hanging system, illustrated in a position for hanging a curtain.

It should of course be understood that the installation strip 110 may be mounted to other suitable shades or blinds or otherwise such as, for example, by the use of strips of material, illustrated at 620 in FIG. 53, the lower end portions of which are attached to the installation strip 110 and which are caused to suitably wrap around the spring-loaded roll 610 or other suitable pulley mechanism for lowering and raising the installation strip 110. For the purposes of this specification and the claims, by "strip" is meant to include straps, strings, wires, ropes, cords, or other elongate items. For another example, as illustrated in FIG. 54, the installation strip 110 may be suitably attached to (or part of) the lower end of a foldable and unfoldable accordion-like structure 630 similar to the hanger rod structure 330 of FIG. 29 wherein plates 334 are connected by rivets 338 and the installation strip 110 is connected by rivets 338 to the lower ends of lower plates 334. The installation strip 110 may be suitably held in a desired down position, as illustrated in FIG. 54, by a suitable bar or plate member, illustrated diagrammatically at 632, which may be suitably adapted to suitably engage a rivet 338 at its lower end and suitably engage a structure (not shown) behind the valence 428 at its upper end or by other suitable means. A clip (not shown) or other suitable means may of course be provided for holding the structure 630 in the folded or up position.

It should be understood that the combination of the pull-down shade 608 with the fastener elements 30 as disclosed in FIGS. 49 to 54 may be used for other purposes, for example, decorative wall coverings or with decorative tassels, wall trimmings, or the like attached, in addition to window treatments, and such other uses are meant to come within the scope of the present invention as defined by the claims. For the purposes of this specification and the claims, the term "panel" is meant to include a curtain or other sheet of cloth or other foldable material.

Figure 50:
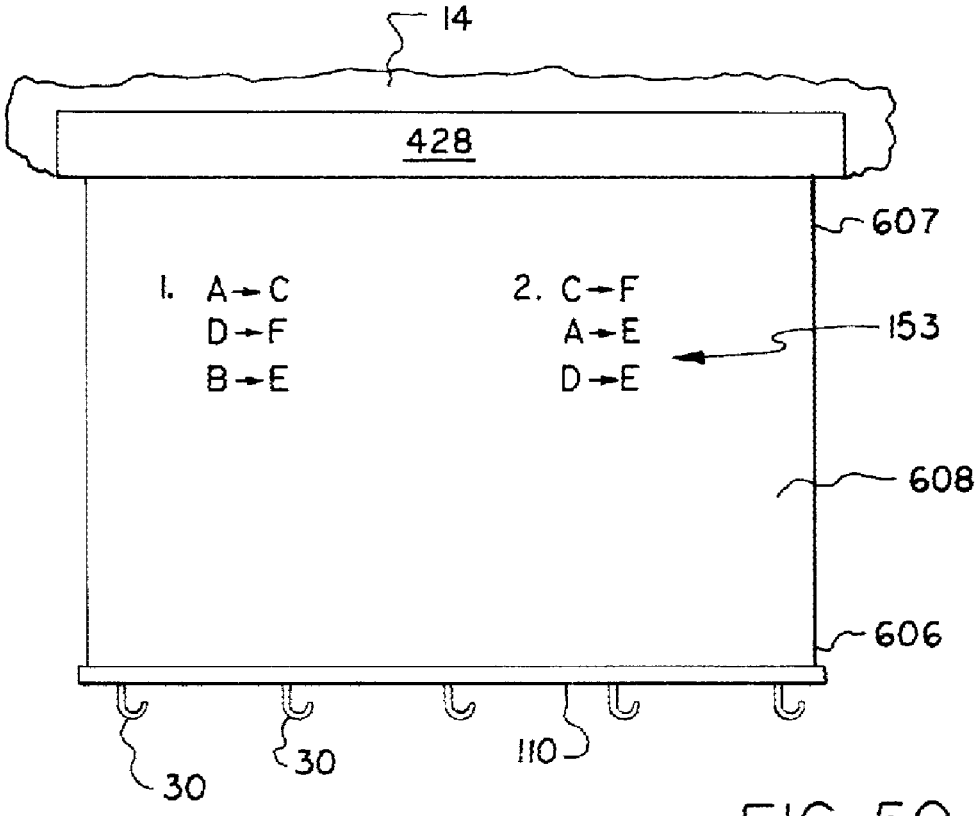
FIG. 50 is a front view of the curtain hanging system, illustrated in a position for hanging a curtain.
Figure 51:
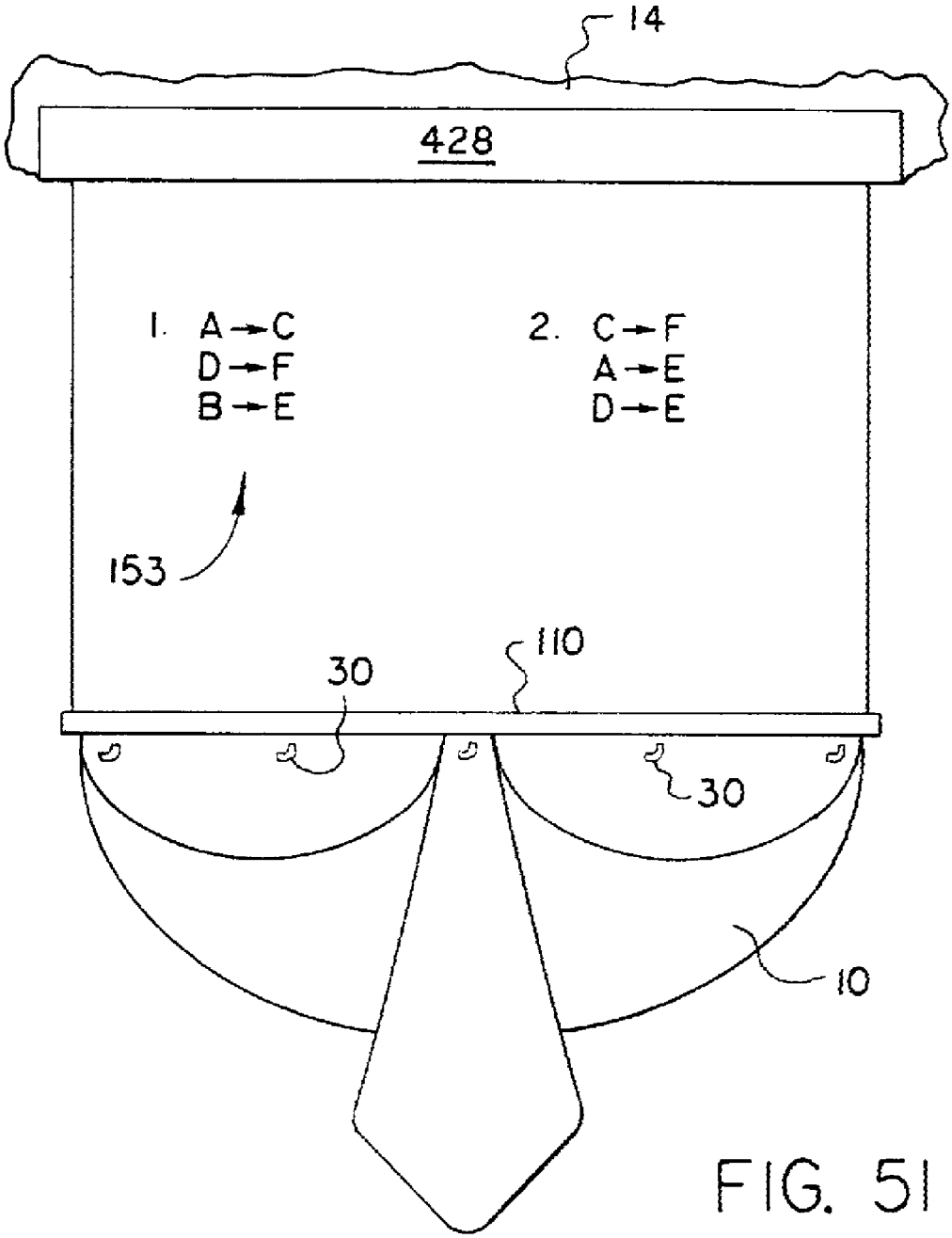
FIG. 51 is a view similar to that of FIG. 50, with the curtain hanging system illustrated with a curtain hung thereon.

Once the installation strip 110 is pulled down by the user to the desired height for easy access, as illustrated in FIG. 50, the user is thusly enabled to easily hang the panels 10 in the chosen pattern, as illustrated in FIG. 51. The user can then cause the shade 608 to be pulled up (returned to the position illustrated in FIG. 49) until the hooks 30 are neatly concealed behind the valence 428, as is apparent from FIG. 52, with the beautiful Window Origami pattern formed by panels 10 over the window 12 neatly visible.

The shade 608 can of course still be used for its customary purposes of blocking the sun and for privacy and the like. Although it may be desired that the shade 608 be plain and/or of a desired color and/or texture, the shade 608 may, if desired, have printed or otherwise suitably placed thereon the instructions 153, including codes and diagrams, for forming the Window Origami treatments, so that the users can have the instructions literally right in front of them for easy selection of patterns and easy use of the codes. While the shade 608 is shown for purposes of illustration to have two sets of codes thereon for forming two Window Origami patterns respectively, it should of course be understood that the shade 608 may have any desired number of such sets of codes, and a web site or other suitable materials can be made accessible for retrieving additional sets of codes. The panels 10 may be arranged in a pleasing pattern while the shade 608 is down or completely removed so that the shade does not have any attachments.

Figure 52:
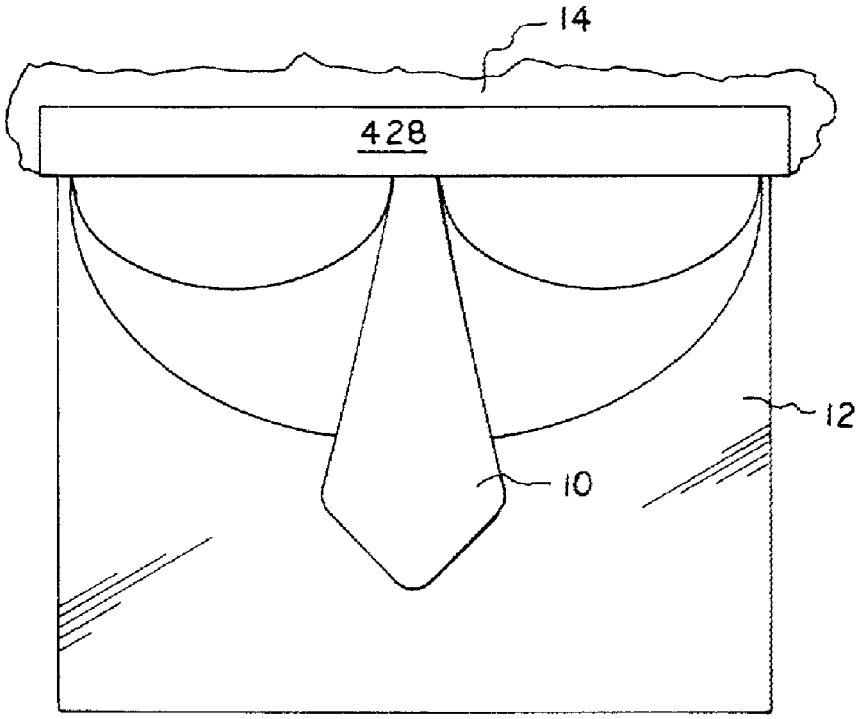
FIG. 52 is a view similar to that of FIG. 50, with the curtain hanging system illustrated in an out-of-the-way position for viewing the curtain hung thereon.

In accordance with the present invention, in order to change or add (or remove) the Window Origami pattern, the shade 608 is first pulled down to the desired height for easy access, as illustrated in FIG. 50, then the panels 10 changed or added at this convenient height, as illustrated in FIG. 51, then the shade 608 raised so that the shade and installation strip and hooks are hidden behind the valence 428, as illustrated in FIG. 52, leaving only the Window Origami pattern visible to be enjoyed.

The attachment of the installation strip/hooks in accordance with the present invention, to a pull-down shade or the like is provided to eliminate the use of a ladder while allowing easy access (for washing, cleaning, rearranging, or changing a curtain, valence, top treatment, or drape) as well as for changing or adding or removing the panels 10 for the desired Window Origami pattern.

The user may then enjoy the view he or she has created.

It should be understood that, while the present invention has been described in detail herein, the invention can be embodied otherwise without departing from the principles thereof, and such other embodiments are meant to come within the scope of the present invention as defined by the appended claims.

What is claimed is:

1. A device for hanging panels, the device comprising a member having a lower edge, a pull-down mechanism for effecting pulling of said lower edge down from a higher to a lower position and for returning said lower edge to the higher position, and a plurality of fastener elements attached to and spaced along said lower edge, the device further comprising in combination therewith at least one panel which comprises a sheet of material having a sheet perimeter and a plurality of fastener elements spaced along and adjacent the sheet perimeter for connecting to said lower edge fastener elements for hanging one edge portion of said panel sheet from said lower edge, said sheet fastener elements being positioned along and adjacent the sheet perimeter in a quantity and spacing over the entirety of the sheet perimeter for connecting to respective ones of said lower edge fastener elements for hanging other edge portions of said panel sheet from said lower edge so that said at least one panel can be hung from said lower edge in a variety of alternative patterns, the device further comprising a plurality of identifier structures attachable to said panel for associating said identifier structures with the plurality of said panel fastener elements respectively, said identifier structures containing identifiers of a first nomenclature which provide information identifying individual ones of the plurality of panel fastener elements respectively, and means defining instructions identifying individual positions of the mating lower edge fastener elements respectively by a second nomenclature and containing steps for forming at least one of the alternative patterns wherein each step refers to said respective identifier of said first nomenclature and said respective identified individual position of the second nomenclature to direct a connecting of a corresponding one of said plurality of panel fastener elements with a corresponding one of said mating lower edge fastener elements.

2. A device according to claim 1 wherein said pull-down mechanism is a pull-down window shade.

3. A device according to claim 1 wherein said pull-down mechanism is attached to an upper window frame, and the device further comprises a valence member attached to the upper window frame for hiding said second plurality of fastener members from view when said lower edge is in said higher position.

4. A device according to claim 1 further comprising an elongate structural member extending along and attached to said lower edge and to which said lower edge fastener elements are attached, wherein said lower edge fastener elements are studs.

5. A device according to claim 1 wherein said panel is a curtain.

6. A device according to claim 1 wherein said member comprises a plurality of horizontally spaced strips of material.

7. A device according to claim 1 wherein said member comprises a plurality of elongate plates pivotally connected in an accordion-like configuration.

8. A device according to claim 1 wherein said means defining instructions is on said member.

9. A device according to claim 1 wherein said instructions are printed on said member.

10. A method for hanging at least one panel having a pair of end edge portions and a pair of side edge portions and a plurality of fastener elements spaced along at least two adjoining ones of the end and side edge portions thereof, the method comprising the steps of:

a) applying to the panel fastener elements identifiers respectively of a first nomenclature so that each of the panel fastener elements is identified;

b) pulling a lower edge of a member having a plurality of spaced fastener elements on the lower edge down from a higher to a lower position;

c) while following a selected plurality of steps each utilizing the first nomenclature to identify one of the panel fastener elements and a second nomenclature identifying the lower edge fastener elements, so that each of the lower edge fastener elements is identified, to identify one of the lower edge fastener elements for connecting of the one of the panel fastener elements thereto, successively hanging a plurality of the edge portions of the panel from the lower edge while the lower edge is in the lower position thereby folding the panel at least once over itself to form a selected one of a plurality of alternative hanging panel patterns, wherein the step of hanging a plurality of the edge portions includes, at least, connecting at least one of the panel fastener elements on one of the end and side edge portions of the panel to one of the lower edge fastener elements, and connecting at least one of the panel fastener elements on an adjoining one of the end and side edge portions of the panel to one of the lower edge fastener elements; and d) effecting return of the lower edge to the upper position.

11. A method according to claim 10 further comprising following one of a plurality of instructions printed on said member for following the selected plurality of steps.

12. A method according to claim 10 wherein the lower edge fastener elements are hooks and the panel fastener elements are holes.

* * * * *